US009829239B2

(12) United States Patent
Buehning et al.

(10) Patent No.: US 9,829,239 B2
(45) Date of Patent: Nov. 28, 2017

(54) COVERS FOR REFRIGERATION SYSTEMS

(71) Applicant: Anthony, Inc., Sylmar, CA (US)

(72) Inventors: James Johann Buehning, Madison, GA (US); John Roche, Bishop, GA (US)

(73) Assignee: Anthony, Inc., Sylmar, CA (US)

( * ) Notice: Subject to any disclaimer, the term of this patent is extended or adjusted under 35 U.S.C. 154(b) by 0 days.

(21) Appl. No.: 15/185,601

(22) Filed: Jun. 17, 2016

(65) Prior Publication Data

US 2017/0138657 A1 May 18, 2017

Related U.S. Application Data

(63) Continuation of application No. 13/677,748, filed on Nov. 15, 2012, now Pat. No. 9,372,025.

(60) Provisional application No. 61/717,033, filed on Oct. 22, 2012.

(51) Int. Cl.

| | |
|---|---|
| ***A47B 96/04*** | (2006.01) |
| ***F25D 23/02*** | (2006.01) |
| ***A47F 3/04*** | (2006.01) |

(52) U.S. Cl.

CPC ..... *F25D 23/026* (2013.01); *A47F 3/043* (2013.01); *F25D 23/021* (2013.01)

(58) Field of Classification Search

CPC ..... A47F 3/043; F25D 23/021; F25D 23/026; F25D 23/02

See application file for complete search history.

(56) References Cited

U.S. PATENT DOCUMENTS

| | | | |
|---|---|---|---|
| 166,043 | A | 7/1875 | Volkland |
| 455,915 | A | 7/1891 | Weiss et al. |
| 908,199 | A | 12/1908 | Birney |
| 1,134,540 | A | 4/1915 | Kress |
| 1,215,873 | A | 2/1917 | Schepis |

(Continued)

FOREIGN PATENT DOCUMENTS

| | | |
|---|---|---|
| CN | 2251701 | 4/1997 |
| DE | 4344310 | 6/1994 |

(Continued)

OTHER PUBLICATIONS

"FRAMEC—Product Lines," Website Archive, Oct. 1999, 7 pages.

(Continued)

*Primary Examiner* — Hanh V Tran
(74) *Attorney, Agent, or Firm* — Fish & Richardson P.C.

(57) ABSTRACT

Covers for use with refrigeration units may include rails that extend across a top opening of the refrigeration unit. One or more lids may be supported by support surfaces on the rails. The lids may be movable (e.g., slidable) between closed and open positions. The lids may include lid plates and feet configured to raise lid plates off of the support surfaces, thereby forming gaps between the lid plates and the support surfaces. The lids may include filling elements to fill at least a portion of the gaps between the lid plates and the support surfaces. In some embodiments, the feet may have a generally Z-shaped configuration. In some embodiments, the cover may include multiple frame elements having transparent spacers at the ends of the frame elements, and the cover may include end pieces at the ends of the cover.

7 Claims, 22 Drawing Sheets

(56) References Cited

U.S. PATENT DOCUMENTS

| | | | | |
|---|---|---|---|---|
| 1,614,319 | A | | 1/1927 | Schmidt |
| 1,711,921 | A | | 5/1929 | Connell et al. |
| 1,881,541 | A | | 10/1932 | Harrison |
| 2,039,685 | A | | 5/1936 | Enrlich |
| 2,189,389 | A | | 2/1940 | Baker |
| 2,201,435 | A | | 5/1940 | Guyton |
| 2,202,684 | A | | 5/1940 | Baker |
| 2,223,023 | A | | 11/1940 | Weilmann |
| 2,276,635 | A | | 3/1942 | Weber |
| 2,305,319 | A | | 12/1942 | Pirnie |
| 2,411,419 | A | | 11/1946 | Frohnapel |
| 2,420,879 | A | | 5/1947 | Herter |
| 2,534,488 | A | | 12/1950 | Weber |
| 2,613,844 | A | | 10/1952 | Mounce |
| 2,694,613 | A | | 11/1954 | Williams |
| 2,793,925 | A | | 5/1957 | Rosen |
| 2,929,227 | A | | 3/1960 | Rainwater |
| 2,946,098 | A | | 7/1960 | Migneault et al. |
| 2,994,572 | A | | 8/1961 | Morrison |
| 3,168,172 | A | | 2/1965 | Alvarez |
| 3,208,809 | A | | 9/1965 | Quimper |
| 3,295,907 | A | | 1/1967 | Thomas |
| 3,410,622 | A | * | 11/1968 | Stewart ..... A47B 47/03 312/219 |
| 3,460,290 | A | | 8/1969 | Wutzke |
| 3,597,036 | A | | 8/1971 | Buffington |
| 3,729,243 | A | | 4/1973 | Musgrave et al. |
| 3,849,951 | A | | 11/1974 | Howle |
| 4,274,267 | A | | 6/1981 | James et al. |
| 4,449,761 | A | | 5/1984 | Davis et al. |
| 4,741,570 | A | | 5/1988 | Lovaas |
| 4,757,913 | A | | 7/1988 | Yerman |
| 4,962,865 | A | | 10/1990 | Kakinuma et al. |
| 4,974,898 | A | | 12/1990 | Baranski |
| 5,167,341 | A | | 12/1992 | Morton et al. |
| 5,261,736 | A | | 11/1993 | Sisbarro |
| 5,727,857 | A | | 3/1998 | Smith |
| 6,017,082 | A | | 1/2000 | Leoni |
| 6,059,243 | A | | 5/2000 | Hikage et al. |
| 6,145,942 | A | | 11/2000 | Borgen |
| 6,206,227 | B1 | | 3/2001 | Ferri |
| 6,247,773 | B1 | | 6/2001 | Harigai et al. |
| 6,260,694 | B1 | | 7/2001 | Sasahara |
| 6,595,381 | B1 | | 7/2003 | Johnson |
| 7,584,843 | B2 | | 9/2009 | Kutsch et al. |
| 8,162,413 | B2 | | 4/2012 | Behr et al. |
| 8,430,460 | B2 | | 4/2013 | Erro et al. |
| 8,500,224 | B2 | | 8/2013 | Moeller |
| RE45,742 | E | | 10/2015 | Behr et al. |
| 2005/0052099 | A1 | | 3/2005 | Behr et al. |
| 2005/0088062 | A1 | | 4/2005 | Akimoto et al. |
| 2007/0001557 | A1 | | 1/2007 | Cianetti |

FOREIGN PATENT DOCUMENTS

| | | |
|---|---|---|
| DE | 29516629 | 2/1996 |
| DE | 19833958 | 1/2000 |
| EP | 0015411 | 9/1980 |
| EP | 0607492 | 7/1994 |
| EP | 0613643 | 9/1994 |
| EP | 0769262 | 4/1997 |
| EP | 0903095 | 3/1999 |
| EP | 0962729 | 12/1999 |
| EP | 1029476 | 8/2000 |
| EP | 1084666 | 3/2001 |
| EP | 1142519 | 10/2001 |
| EP | 1332698 | 8/2003 |
| EP | 1437073 | 8/2003 |
| EP | 1391334 | 2/2004 |
| EP | 1391171 | 10/2005 |
| EP | 1967402 | 2/2008 |
| GB | 548629 | 10/1942 |
| GB | 2256000 | 11/1992 |
| IT | TO 940171 U1 | 2/1996 |
| JP | 5423249 | 2/1979 |
| SU | 1518472 | 10/1989 |
| WO | WO 95/25254 | 9/1995 |
| WO | WO 97/17581 | 5/1997 |

OTHER PUBLICATIONS

"FRAMEC—J. Dream and SCG Lines," Website Archive, Oct. 1999, 1 page.
"NOVUM 602SC," Website Archive, May 2001, 2 pages.
"NOVUM 603," Website Archive, May 2001, 2 pages.
"Caravell Commercial Products," Website Archive, Jun. 2000, 2 pages.
"Master-Bilt—Ice Cream, Frozen Food & Dairy Merchandisers," Website Archive Feb. 2001, 5 pages.
"Stylish Curves, More Display Space and Greater Visibility for Products," Quick Frozen Foods International, Oct. 1999, pp. 126-128.
Images publicly available at least as early as Jul. 26, 2012, 4 pages. Images representative of the cover portion of a refrigeration unit that was publicly displayed by Anthony, Inc. (DBA Anthony International) at the Food Market Institutes trade show in Apr. 2012 at Dallas, TX.
Complaint for patent infringement, filed Jul. 20, 2012 in *Behr* v. *Anthony, Inc*., Case No. 2:12-cv-06253-ODW-JEM in the United States District Court for the Central District of California.
Answer to complaint for patent infringement, filed Aug. 24, 2012 in *Behr* v. *Anthony, Inc*., Case No. 2:12-cv-06253-ODW-JEM in the United States District Court for the Central District of California.
Behr's Answer to counterclaims, filed Sep. 17, 2012 in *Behr* v. *Anthony, Inc*., Case No. 2:12-cv-06253-ODW-JEM in the United States District Court for the Central District of California.
Behr's disclosure of asserted claims and infringement contentions, dated Mar. 18, 2013 in *Behr* v. *Anthony, Inc*., Case No. 2:12-cv-06253-ODW-JEM in the United States District Court for the Central District of California.
Order of dismissal, filed Apr. 18, 2013 in *Behr* v. *Anthony, Inc*., Case No. 2:12-cv-06253-ODW-JEM in the United States District Court for the Central District of California.
International Search Report; PCT/DK03/00046; Apr. 4, 2003.
Trendir Curved Sliding Door, website archive dated Sep. 2, 2010, http://www.trendir.com/archives/001608.html.
Keep Cool Curve Brochure, downloaded Sep. 5, 2012.
Photographs of refrigeration cases, taken earlier than Oct. 21, 2011, 15 pages.
Remis Catalog 2011, which appears to have a date of Feb. 2011, 52 pages.
Photograph of refrigeration case, taken Aug. 14, 2012, 1 page.

* cited by examiner

COVERS FOR REFRIGERATION SYSTEMS

CROSS-REFERENCE TO RELATED APPLICATIONS

This application is a continuation of U.S. patent application Ser. No. 13/677,748, titled COVERS FOR REFRIGERATION SYSTEMS, and filed on Nov. 15, 2012, which claims the benefit under 35 U.S.C. §119(e) of U.S. Provisional Application No. 61/717,033, titled COVERS FOR REFRIGERATION SYSTEMS, and filed on Oct. 22, 2012. The entirety of each of the above-identified applications is hereby incorporated by reference herein and made a part of this specification for all that it discloses.

BACKGROUND OF THE DISCLOSURE

Field of the Disclosure

This disclosure relates to covers for storage or display units, such as those used in refrigeration systems.

Description of the Related Art

Although various conventional covers exist that can be used with refrigeration systems and other storage or display units, conventional covers suffer from various drawbacks. For example, some covers include doors or lids that create gaps. While the gaps enable doors and lids to easily slide above, they can disadvantageously allow relatively warm ambient air to enter the refrigerated area inside the refrigeration system. Air exchange between the refrigerated area and the ambient area outside the refrigeration system can cause condensation to form on surfaces inside the refrigerated area. In some cases, the condensation can drip, which can be harmful to the goods contained in the refrigerated areas, and which can form puddles inside the refrigerated area. The condensation can freeze, causing frost or frozen puddles within the refrigerated area.

SUMMARY OF THE INVENTION

Various embodiments disclosed herein may relate to a cover for use with a refrigeration unit. The cover may include a plurality of rails configured to extend across a top opening of the refrigeration unit. The plurality of rails may include one or more support surfaces. The cover may include a lid configured to slidably engage the support surfaces such that the lid is slidable between a closed position and an open position. The lid may include a lid plate having a top surface and a bottom surface and a plurality of feet coupled to the lid plate, such that a gap is positioned between the bottom surface of the lid plate the support surface. The lid may include a filling element positioned between the feet such that the filling element fills at least a portion of the gap, thereby restricting air flow through the gap.

Various embodiments disclosed herein may relate to a lid, which may be used with a cover for a refrigeration unit. The lid may include a lid plate having a top surface and a bottom surface and a plurality of feet coupled to the lid plate, such that a gap is positioned under the bottom surface of the lid plate. The lid may include a filling element positioned under the lid plate such that the filling element fills at least a portion of the gap, thereby restricting air flow through the gap.

Various embodiments disclosed herein may relate to a frame element for use with a cover for a refrigeration unit. The frame element may include a right side rail, a left side rail, and a spacer extending between the right side rail and the left side rail at a first end of the frame element. In some embodiments, the first spacer may include a transparent material.

Various embodiments disclosed herein may relate to a foot, which may be used with a sliding lid. The foot may include a main portion extending generally horizontally, an upper flange extending generally vertically upward from an outer side of the main portion of the foot, and a lower flange extending generally vertically downward from an inner side of the main portion of the foot.

Various embodiments disclosed herein may relate to a rail, which may be used with a cover for a refrigeration unit. The rail may include a main body, and a supplemental support member, which may be coupled to the main body. In some embodiments, the supplemental support member extends less than a full length of the rail. The rail may include at least one support surface formed on the main body, and an additional support surface formed on the supplemental support member.

BRIEF DESCRIPTION OF THE DRAWINGS

Embodiments will now be described with reference to the drawings summarized below. These drawings and the associated description are provided to illustrate example embodiments, and not to limit the scope of the invention.

DETAILED DESCRIPTION OF CERTAIN EMBODIMENTS

Figure 1:
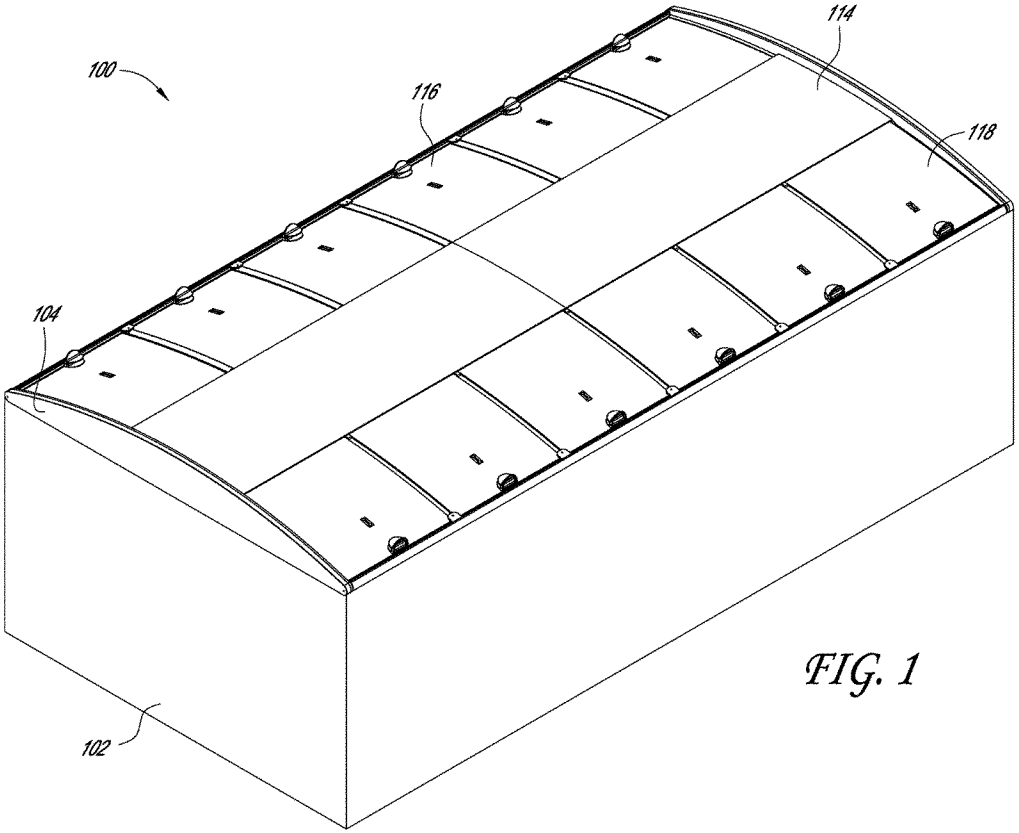
FIG. 1 is a perspective view of an example embodiment of a cover attached to a refrigeration unit.
Figure 2:
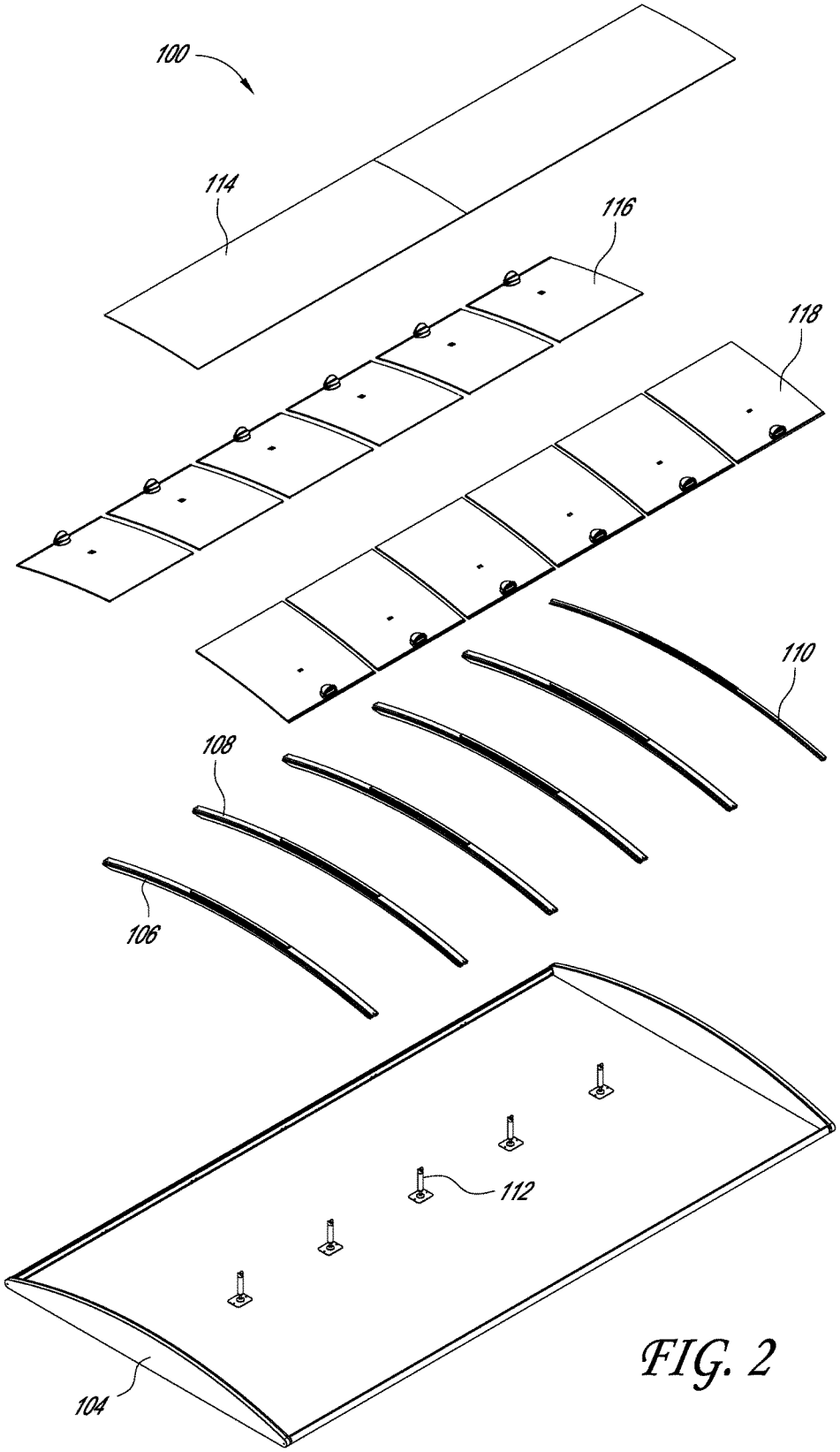
FIG. 2 is an exploded view of the cover of FIG. 1.

FIG. 1 is a perspective view of a cover 100 attached to a refrigeration unit 102. FIG. 2 is an exploded view of the cover 100. The refrigeration unit 102 may be generally rectangular in shape, although other shapes may be used. The refrigeration unit 102 may be refrigerated to a variety of temperatures (e.g., about −40 C, about −30 C, about −20 C, about −10 C, about 0 C, about 5 C, about 10 C, about 15 C, etc., or other suitable temperature or temperature range). The refrigeration unit 102 may have an internal compartment, which may be insulated, and an opening, which may, for example, be a top opening that opens in an upwardly facing direction. In some embodiments, the internal compartment (hidden from view in FIG. 1) may be divided into two or more chambers or areas by internal walls disposed inside the refrigeration unit 102. For example, a wall (not shown in FIG. 1) may extend generally along the longitudinal axis of the refrigeration unit to divide the internal compartment into left and right chambers. The cover may include a frame 104, which may be generally rectangular in shape, although other shapes may be used. The frame 104 may conform to the general shape of the refrigeration unit 102 (e.g., to the top opening thereof). The frame 104 may be configured to be mounted onto the top of the refrigeration unit 102, e.g., on a lip surrounding the top opening.

The cover 100 may include a plurality of rails 106, 108, and 110, which may extend at least partially across the refrigeration unit, e.g., across the top opening thereof. End rails 106 and 110 may be positioned at the opposing ends of the cover 100, and one or more central rails 108 may be positioned between the end rails 106 and 110, and may be distributed (e.g., substantially evenly distributed) across the top opening between the end rails 106 and 110. In some embodiments, some or all of the rails 106, 108, and 110 may extend substantially entirely across the cover 100 (e.g., from a right side of the cover 100 to a left side of the cover 100). The rails 106, 108, 110 may be curved, as shown, although in some embodiments, the rails may be substantially linear or of other shape. Curved rails 106, 108, and 110 may increase the amount of useful refrigerated volume within the refrigeration unit, as compared to linear rails. The rails 106, 108, 110 may be attached to the center plates 114 prior to being mounted to or rested on the frame 104 or refrigeration unit 102, or the rails 106, 108, 110 may be first attached to the frame 104 or refrigeration unit 102, and then to the center plates 114.

Some or all of the rails 106, 108, and 110 may be supported by rail supports 112. The rail supports 112 may be configured to rest on a portion of the refrigeration unit (not shown in FIG. 2), such as on the top of an internal wall within the internal compartment, or on the floor of the internal compartment. In some embodiments, the one or more rail supports 112 may be height adjustable, such as be using telescoping shafts, which may have holes and pins that allow the rail supports 112 to be set to various different heights depending on the configuration of the refrigeration unit 102. The rail supports 112 may be configured to support the rails 108, e.g., at the central portions or other portions of the rails 108. For example, the rail supports 112 may have an upper portion that is shaped to interface or mate with the shape of the bottom of the rails 108, e.g., so that the rails 108 rest on the rail supports 112. The rails 106, 108, and 110 may support center plates 114, lids 116, and lids 118, as discussed herein.

Figure 3:
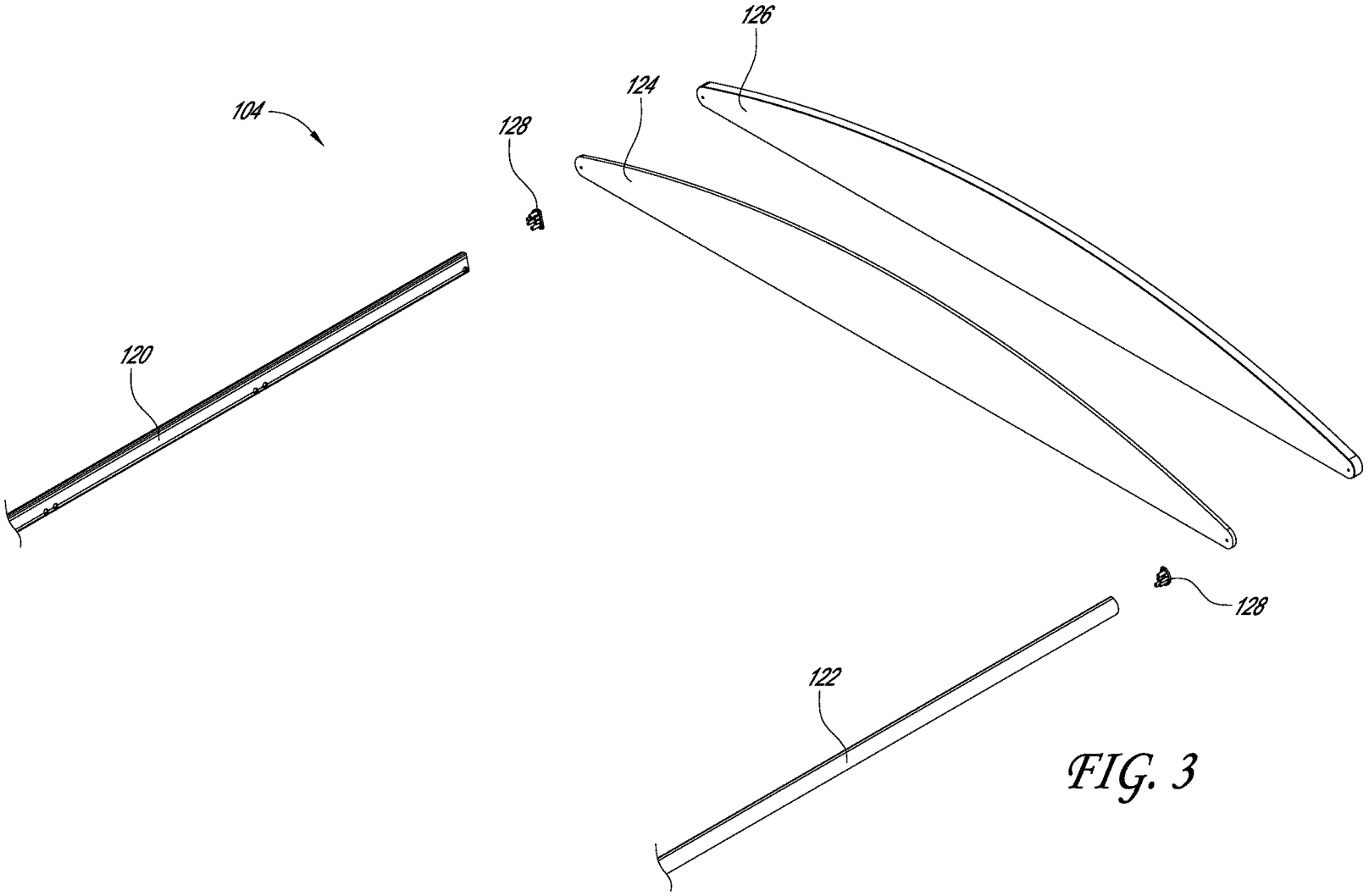
FIG. 3 is an exploded partial view of the example cover frame.

FIG. 3 is an exploded partial view of the frame 104. The frame 104 may include a left side rail 120 and a right side rail 122. The ends of the rails 108 (not shown in FIG. 3) may be coupled to the side rails 120 and 122, such that the side rails 120 and 122 provide support to the ends of the rails 108. The frame 104 may include spacers 124 positioned at the ends of the side rails 120 and 122. The spacer 124 may have a generally flat bottom surface, which may be configured to interface with a side wall of the refrigeration unit 102, and the spacer 124 may have a curved top surface, which may have a curvature similar to the curvature of the rails 106, 108, and 110. The side rails 120 and 122 may be coupled to the spacer 124 by connectors 128, and/or by an adhesive, and/or by bolts and/or rivets, and/or by any other suitable attachment mechanism. The connectors 128 may have a side that may fit into a hollow portion of the corresponding side rail 120 or 122 or may fit over the corresponding side rail 120 or 122, and the connectors 128 may be coupled to the spacer 124 (e.g., by an adhesive, bolts or rivets, and/or by any other suitable attachment mechanism). The spacer 124 may be formed of a rigid and/or transparent material, e.g., polycarbonate, acrylic, glass, etc.

In some embodiments, an end board 126 may be disposed at the end of the frame 104. For example, the end board 126 may be disposed on the side of the spacer 124 opposite the side rails 120 and 122. The spacer 124 may be coupled to the end board 126 by an adhesive, by bolts or rivets, and/or any other suitable attachment mechanism. The end board 126 may be formed from various materials. For example, in some embodiments, the end board 126 may be foam filled, and the end board 126 may be sanded and/or painted to match the side rails 120 and 122, or the end board 126 may have a coating or skin that color matches the side rails 120 and 122. In some embodiments, the end boards 126 may be formed of a high-density polyethylene (HDPE) material (e.g., substantially throughout the end board 126), which may be color matched to the side rails 120 and 122. The HDPE end boards 126 may provide improved rigidity and may be cost effective to produce.

In some embodiments, the spacer 124 may be omitted and the side rails 120 and 122 may be coupled to the ends of the end boards 126. In some embodiments, the end boards 126 may be omitted, so that the spacers 124 form the ends of the frame 104.

Figure 4:
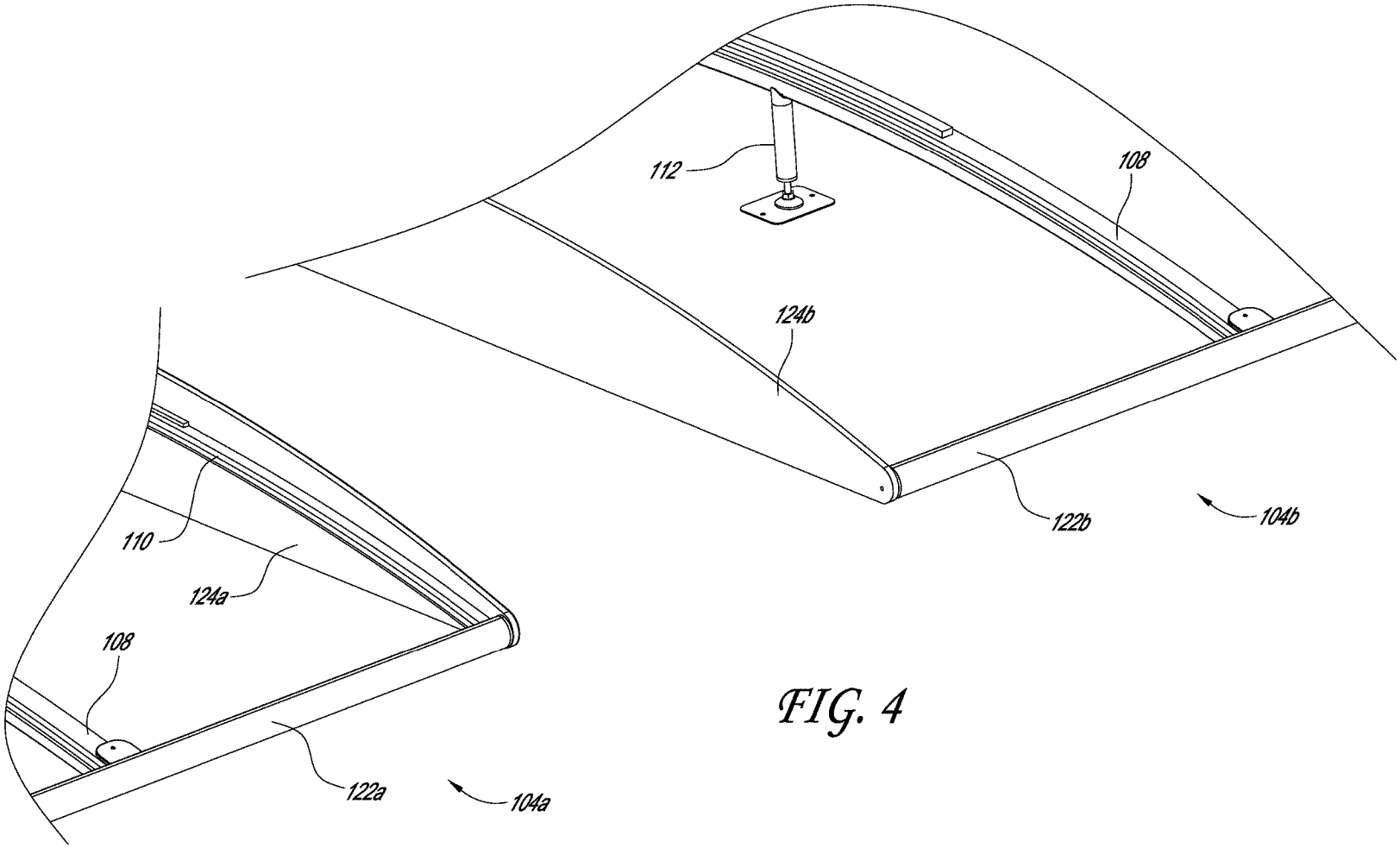
FIG. 4 shows an exploded partial view of two example frame elements, in an uncoupled configuration.
Figure 5:
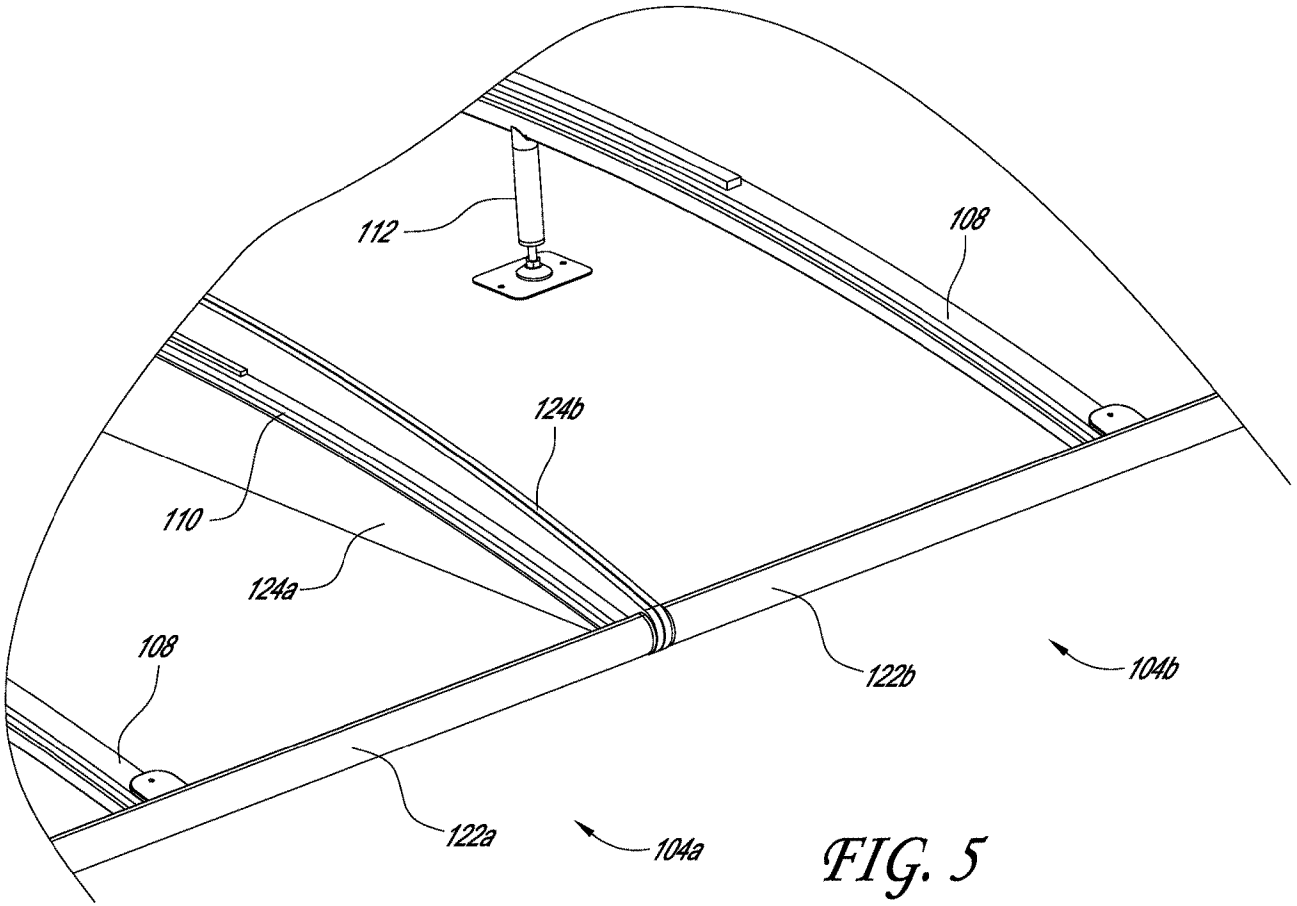
FIG. 5 shows the two frame elements in a coupled configuration.

With reference to FIGS. 4 and 5, the spacers 124 may facilitate the shipping and assembly of frames that include multiple frame elements 104*a* and 104*b*. In some implementations, a refrigeration unit 102 may be sized to receive a single frame 104 (e.g., the 6-door, 12-foot refrigeration unit of FIG. 1). However, in some implementations, a refrigeration unit may be longer than that shown in FIG. 1. For example, refrigeration units may be about 24 feet long, 48 feet long, etc. In some embodiments, the frame 104 may include multiple frame elements 104*a* and 104*b*, which may be combined to form the frame 104 (especially for longer refrigeration units). For example, a 48-foot long refrigeration unit may include four frame elements, each about 12 feet long. In some embodiments, end boards 126 may be disposed at the ends of the full frame 104 (e.g., as shown in FIG. 3), and the spacers 124 may be disposed between adjacent frame elements 104*a* and 104*b*. FIG. 4 shows an exploded partial view of two frame elements 104*a* and 104*b*, in an uncoupled configuration. Optionally, the rails 106, 108, 110 may be attached to the center plates 114 prior to shipment for easier assembly by the receiver. FIG. 5 shows the two frame elements 104*a* and 104*b* in an assembled (e.g., coupled) configuration. The adjacent spacers 124*a* and 124*b* of the frame elements 104*a* and 104*b* may be coupled by an adhesive, by bolts and/or rivets, by clamps, and/or by other suitable attachment mechanisms. In some embodiments, the spacers 124*a* and 124*b* may be formed of a rigid material (e.g., polycarbonate) and the spacers 124*a* and 124*b* may provide support to the corresponding frame elements 104*a* and 104*b*. The spacers 124*a* and 124*b* may allow the frame elements 104*a* and 104*b* to be assembled independently, rather than assembling or installing the full length of the complete frame at once, which may simplify assembly. Also, the frame elements 104*a* and 104*b* may be shipped or otherwise transported in an assembled configuration, and the cover elements 104*a* and 104*b* may be combined (e.g., as shown in FIG. 5) during installation to make covers of relatively large lengths (e.g., having two or more frame elements). Because the spacers 124*a* and 124*b* enable the individual cover elements 104*a* and 104*b* to be assembled individually and to be transported in an assembled configuration to the installation site, the installation process of the full cover that is performed at the installation site may be simplified, as compared to performing the assembly of the full cover (e.g., without spacers 124) at the installation site.

In some embodiments, the spacers 124 may be substantially transparent. For example, the spacers 124 may be formed of polycarbonate, acrylic, glass, or other suitable materials that are substantially transparent. The transparent spacers 124 may enable a user to view a portion of the internal compartment of the refrigeration unit even if the user's line of sight passes through the spacers 124. For example, if a user is standing next to the cover element 104*a*, the user may look through the spacers 124*a* and 124*b* to view the portion of the internal compartment that is under the cover element 104*b*.

Figure 6:
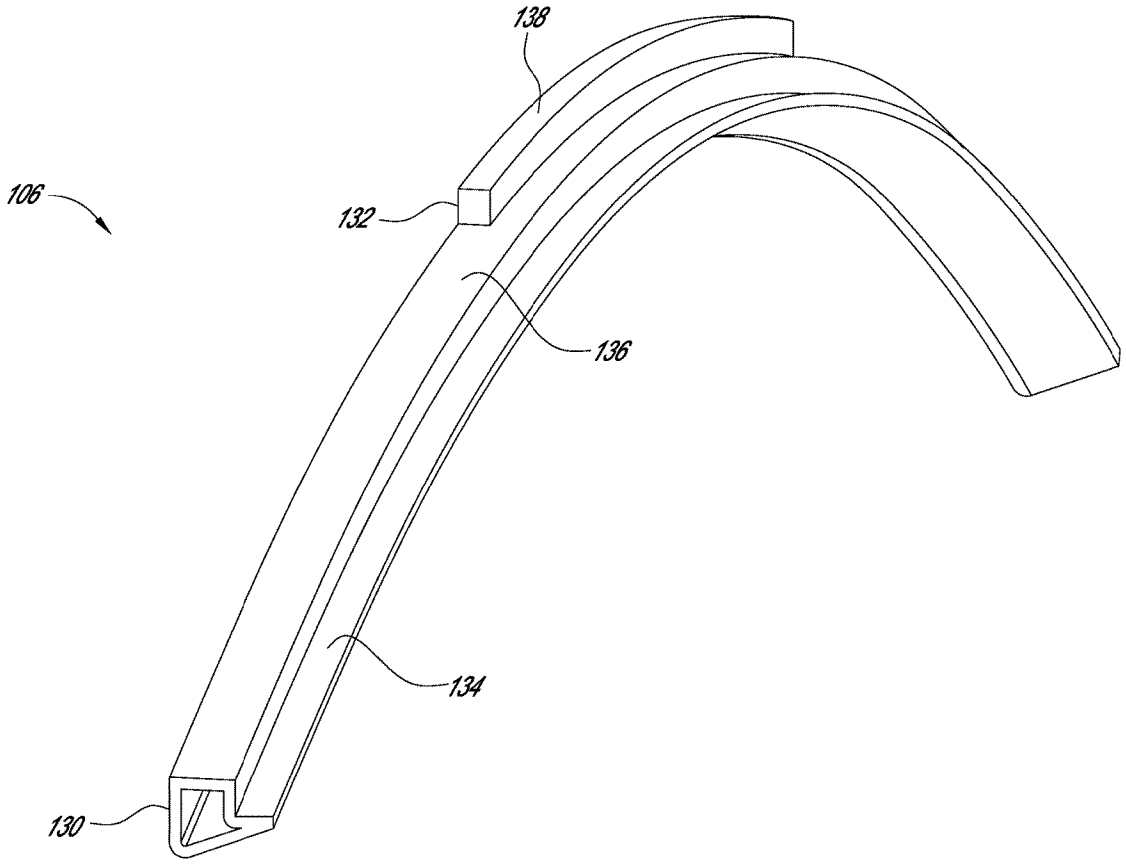
FIG. 6 is a perspective view of an example embodiment of an end rail.
Figure 7:
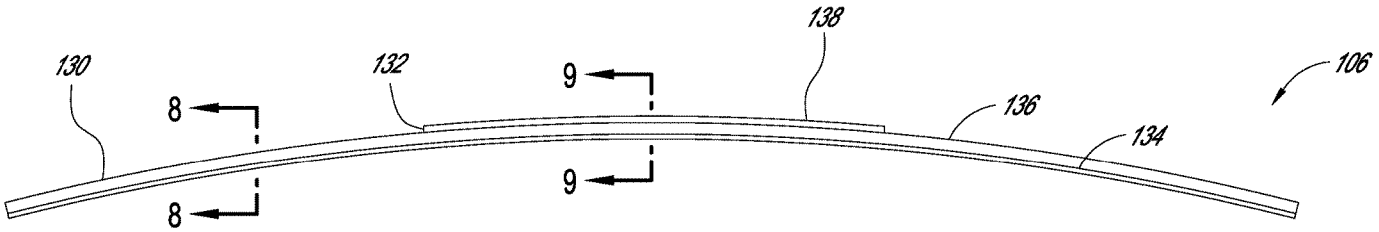
FIG. 7 is a side view of the end rail of FIG. 6.
Figure 9:
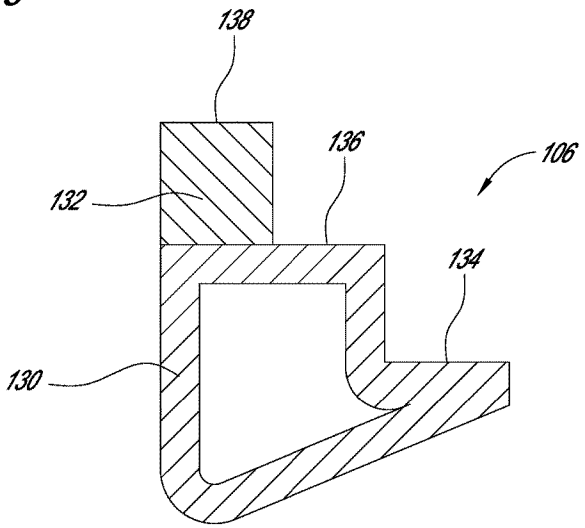
FIG. 9 is a cross-sectional view of the end rail taken through the line 9-9 of FIG. 7.
Figure 8:
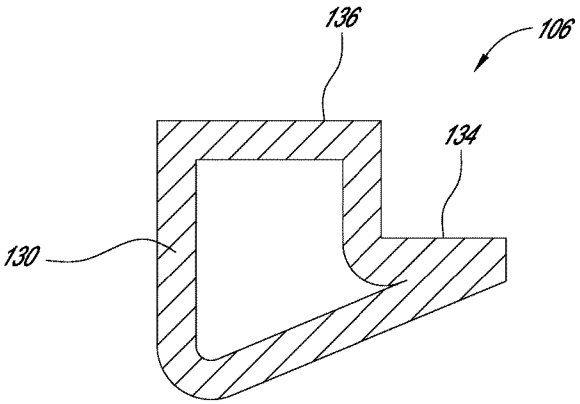
FIG. 8 is a cross-sectional view of the example end rail taken through the line 8-8 of FIG. 7.

FIG. 6 is a perspective view of the end rail 106. FIG. 7 is a side view of the end rail 106. FIG. 8 is a cross-sectional view of the end rail 106 taken through the line 8-8 of FIG. 7. FIG. 9 is a cross-sectional view of the end rail 106 taken through the line 9-9 of FIG. 7. The end rail 106 may be curved, as shown, or it may have a substantially linear construction. The end rail 106 may include a main body 130, which may extend from one side of the cover 100 to the other. The main body 130 may be formed of a rigid plastic material and may be extruded, molded, and/or milled. In some embodiments, the main body 130 may be extruded into a linear piece having a substantially constant cross-sectional shape along the length thereof, and the extruded piece may be bent to form the curved shape of the main body 130. The end rail 106 may include an additional support member 132, which may be configured to provide support for a center plate 114 (not shown in FIGS. 6-9). The center plate 114 may be movable or fixed in position. The additional support member 132 may be formed of a rigid material and may be formed using processes similar to those discussed in connection with the main body 130. For example, the additional support member 132 may be extruded, molded, and/or milled. In some embodiments, the additional support member 132 may be extruded into a linear piece and may be bent to have a curvature that corresponds to the curvature of the main body 130. The additional support member 132 may have a length that is about ⅓ the length of the main body 130 (e.g., at least about ¼ of the length and or less than or equal to about ½ of the length of the main body 130). The supplemental support member 132 may be spaced apart from the ends of the main body 130, and may be positioned generally in the central portion of the end rail 106. The supplemental support member 132 may be coupled to the top of the main body 130 (e.g., using an adhesive, double-sided tape, bolts or rivets, and/or other suitable attachment mechanisms). In some embodiments, the main body 130 and the supplemental support member 132 may be bent together after being coupled, or they may be bent separately and coupled thereafter. With reference to FIG. 9, in some embodiments, the supplemental support member 132 can be positioned further to the right than as shown, for example, so that the supplemental support member 132 is spaced apart from the spacer 124 or other side wall portions of the cover 100. In some embodiments, the supplemental support member 132 can first be coupled to the center plate 114 (e.g., using double-sided tape), and the center plate 114 and supplemental support member 132 can then be coupled to the main body 130 (e.g., using double-sided tape). Accordingly, the positioned of the supplemental support member 132 can be positioned differently than as shown in FIG. 9 (e.g., to the right or to the left of the position shown in FIG. 9).

The end rail 106 may include one or more support surfaces. In the illustrated example the end rail includes at least a first support surface 134, a second support surface 136, and a third support surface 138. The first support surface 134 and the second support surface 136 may be formed on the main body 130, and the third support surface 138 may be formed on the top surface of the supplemental support member 132. The third support surface 138 may extend only about ⅓ of the length of the end rail 106 (e.g., at least about ¼ of the length and or less than or equal to about ½ of the length of the end rail 106), reducing costs in certain embodiments and easing assembly. In this example, the support surface 138 does not contain center plate 114, or lids 116, 118, but instead provide a resting surface. The support surfaces 134, 136, and 138 may be substantially parallel to each other, and in some embodiments, may be substantially concentric.

Figure 10:
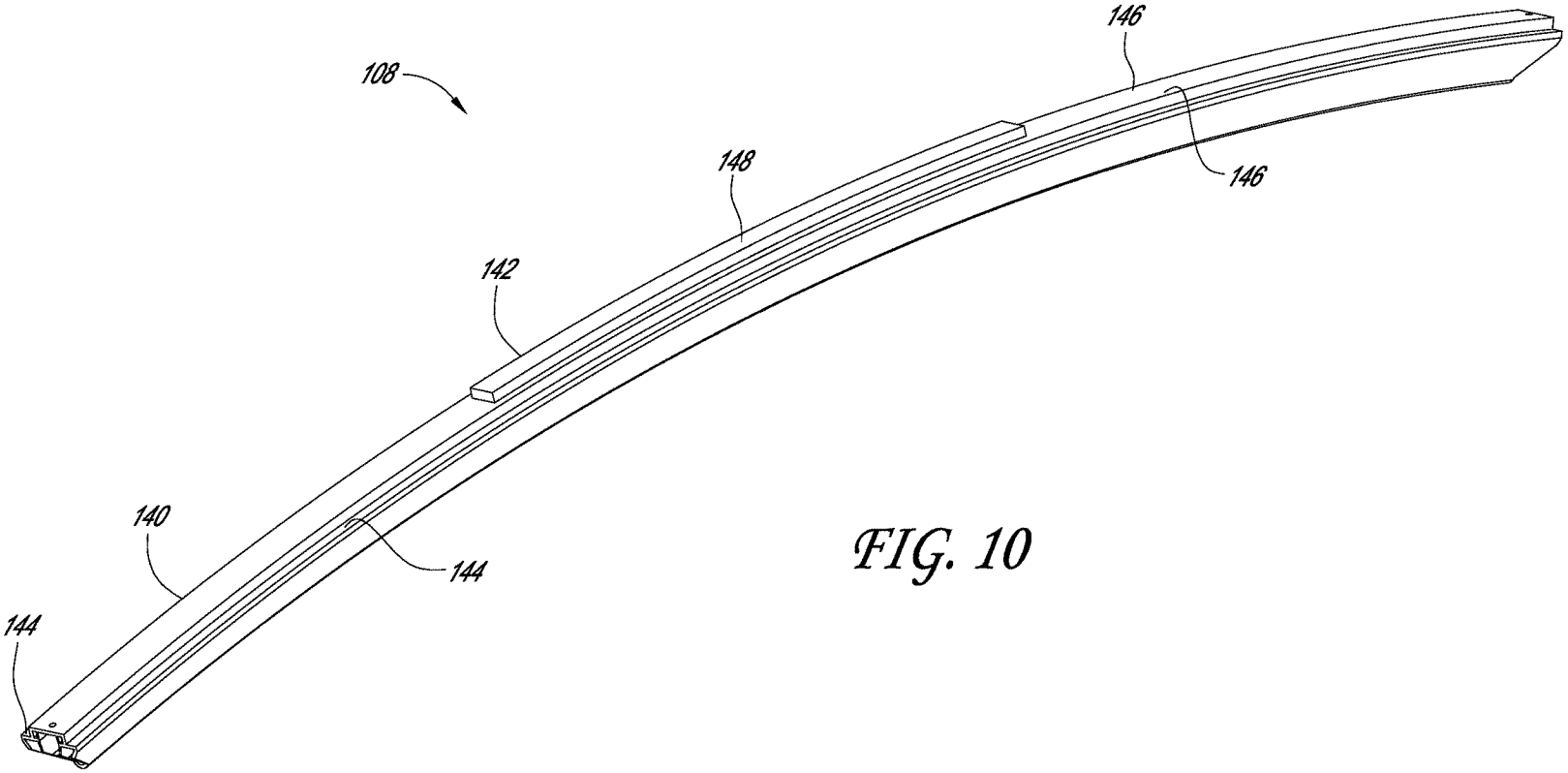
FIG. 10 is a perspective view of an example embodiment of a central rail.
Figure 11:
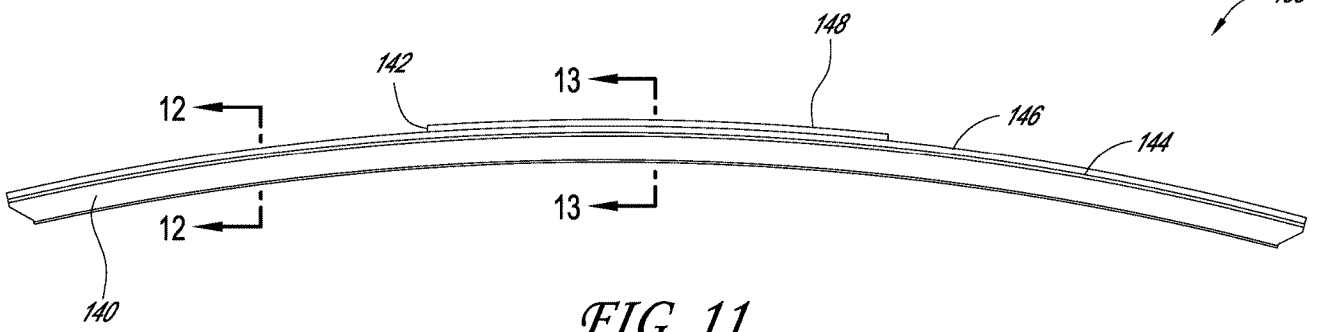
FIG. 11 is a side view of the example central rail of FIG. 10.
Figure 13:
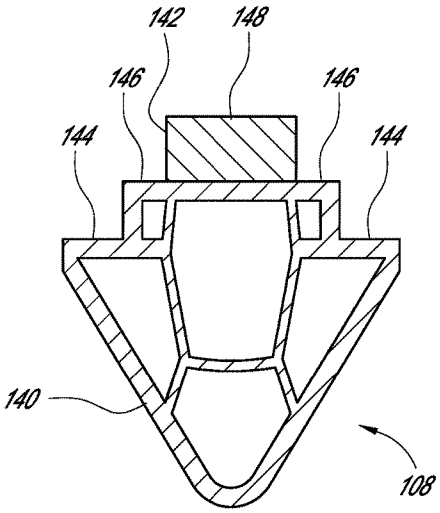
FIG. 13 is a cross-sectional view of the central rail taken through the line 13-13 of FIG. 11.
Figure 12:
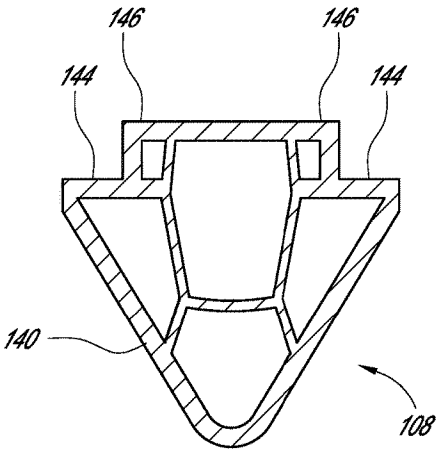
FIG. 12 is a cross-sectional view of the central rail taken through the line 12-12 of FIG. 11.
Figure 15:
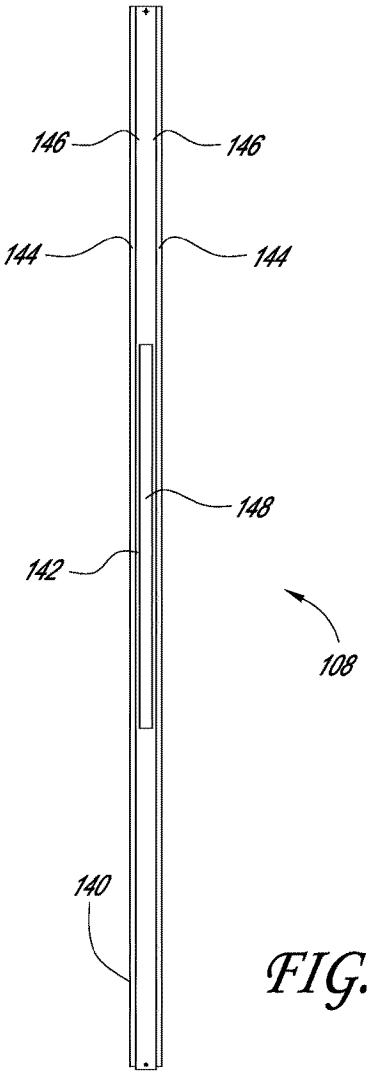
FIG. 15 is a top-down view of the of the example central rail of FIG. 10.
Figure 14:
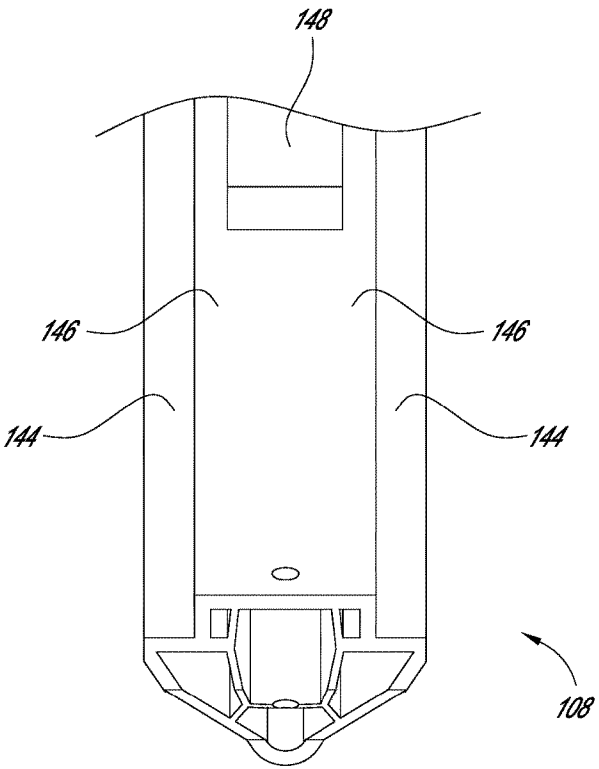
FIG. 14 is a side view of the central rail of taken from an angle transverse to the view of FIG. 11.

FIG. 10 is a perspective view of a central rail 108. FIG. 11 is a side view of the central rail 108. FIG. 12 is a cross-sectional view of the central rail 108 taken through the line 12-12 of FIG. 11. FIG. 13 is a cross-sectional view of the central rail 108 taken through the line 13-13 of FIG. 11. FIG. 14 is a side view of the central rail 108 taken from an angle transverse to the view of FIG. 11. FIG. 15 is a top-down view of the central rail 108. The central rail 108 may have features similar to those described in connection with the end rail 106, and the discussion relating the end rail 106 may relate to the central rail 108 as well. The central rail 108 may be curved, as shown, or it may have a substantially linear construction. The central rail 108 may include a main body 140, which may extend from one side of the cover 100 to the other side. The main body 140 may be formed of a rigid plastic material and may be extruded, molded, and/or milled. In some embodiments, the main body 140 may be extruded into a linear piece having a substantially constant cross-sectional shape along the length thereof, and the extruded piece may be bent to form the curved shape of the main body 140. The central rail 108 may include an additional support member 142, which may be configured to provide support for a center plate 114 (not shown in FIGS. 10-15). The additional support member 142 may be formed of a rigid material and may be formed using processes similar to those discussed in connection with the main body 140. For example, the additional support member 142 may be extruded, molded, and/or milled. In some embodiments, the additional support member 142 may be extruded into a linear piece and may be bent to have a curvature that corresponds to the curvature of the main body 140. The additional support member 142 may have a length that is about ⅓ the length of the main body 140 (e.g., at least about ¼ of the length and or less than or equal to about ½ of the length of the main body 140). The supplemental support member 142 may be spaced apart from the ends of the main body 140, and may be positioned generally in the central portion of the central rail 108. The supplemental support member 142 may be coupled to the top of the main body 140 (e.g., using an adhesive, double-sided tape, bolts and/or rivets, and/or other suitable attachment mechanisms). In some embodiments, the main body 140 and the supplemental support member 142 may be bent together after being coupled, or they may be bent separately and coupled thereafter.

The central rail 108 may include first support surfaces 144 on both sides of the central rail 108, second support surfaces 146 on both sides of the central rail 108, and a third support surface 148. The first support surfaces 144 and the second support surfaces 146 may be formed on the main body 140, and the third support surface 148 may be formed on the top surface of the supplemental support member 142. The third support surface 148 may extend only about ⅓ of the length of the central rail 108 (e.g., at least about ¼ of the length and or less than or equal to about ½ of the length of the central rail 108). The support surfaces 144, 146, and 148 may be substantially parallel to each other, and in some embodiments, may be substantially concentric.

Figure 16:
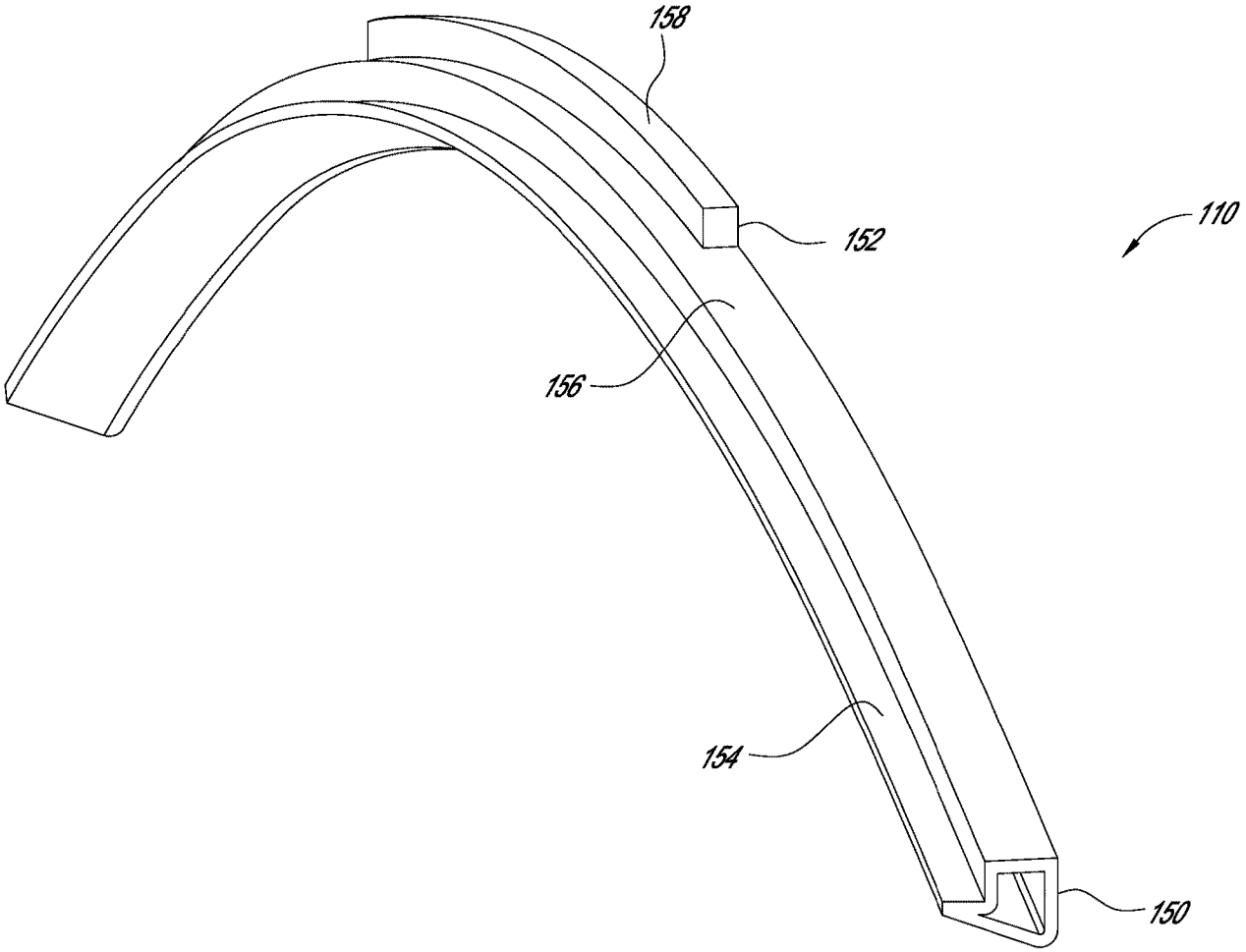
FIG. 16 is a perspective view of an example embodiment of an end rail 110.
Figure 17:
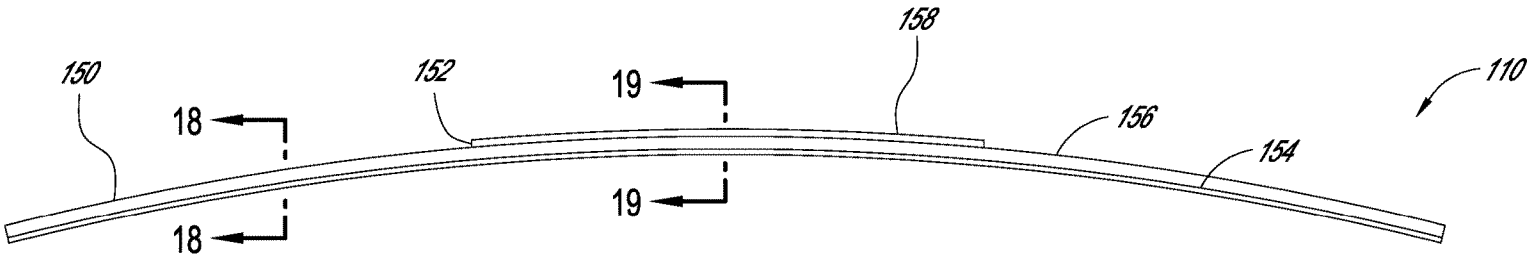
FIG. 17 is a side view of the end rail of FIG. 16.
Figure 19:
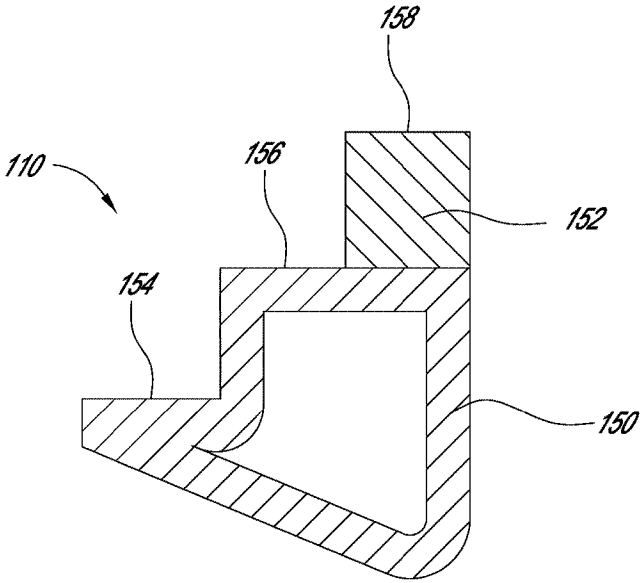
FIG. 19 is a cross-sectional view of the end rail taken through the line 19-19 of FIG. 17.
Figure 18:
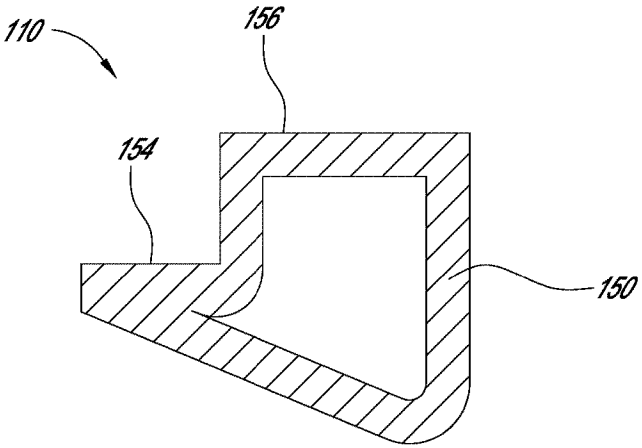
FIG. 18 is a cross-sectional view of the example end rail taken through the line 18-18 of FIG. 17.

FIG. 16 is a perspective view of the end rail 110. FIG. 17 is a side view of the end rail 110. FIG. 18 is a cross-sectional view of the end rail 110 taken through the line 18-18 of FIG. 17. FIG. 19 is a cross-sectional view of the end rail 110 taken through the line 19-19 of FIG. 17. The end rail 110 may have features similar to those described in connection with the end rail 106, and the discussion relating the end rail 106 may relate to the central rail 108 as well. The end rail 110 may be a mirror image of the end rail 106, and the end rail 110 may be positioned on the opposite side of the cover 100 from the end rail 106. The end rail 110 may have a main body 150, a supplemental support member 152, a first support surface 154, a second support surface 156, and a third support surface 158 that are similar to the corresponding features of the end rail 106 discussed herein, and description of the features of the end rail 106 also apply to the corresponding features of the end rail 110.

Figure 20:
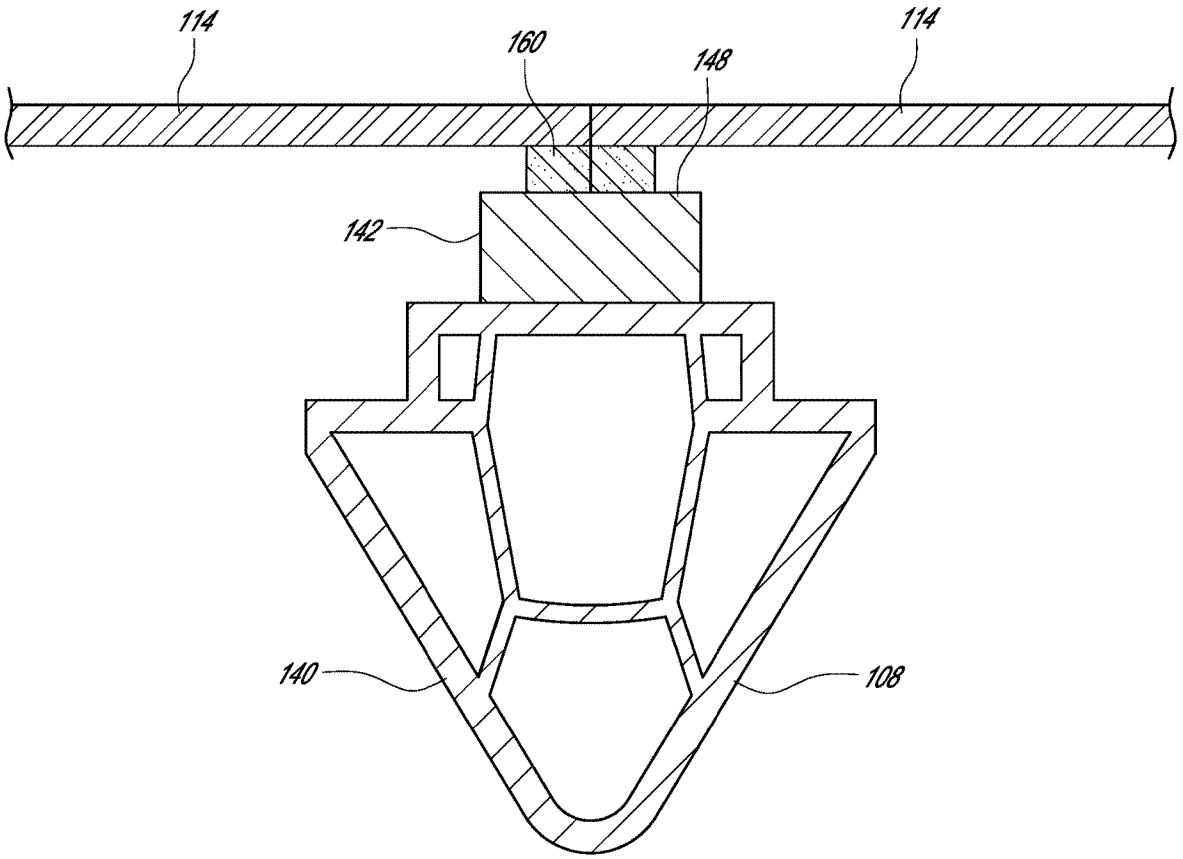
FIG. 20 is a cross-sectional view showing center plates supported on a central rail.

FIG. 20 is a cross-sectional view showing center plates 114 supported on the third support surface 148 of a central rail 108. In some embodiments, the center plates 114 may be secured to the support surface 148, e.g., by double sided tape 160, or by an adhesive, or by another suitable attachment mechanism. In some embodiments, the central plates 114 are held substantially stationary in place once installed. As may be seen in FIGS. 1 and 2, in some embodiments, a single center plate 114 may extend across multiple rails 108. For example, as shown in FIGS. 1 and 2, a center plate 14 extends over three central rails 108 and over an end rail 106. Many variations are possible. In some embodiments, a single center plate 114 may used, and in some cases, the center plate 114 may extend substantially the full length of the cover 100. Because the rails 108 optionally do not include a divider portion that extends upward between adjacent center plates 114, the one or more center plates 114 may extend over multiple rails 108, and the number of parts may be reduced, and the assembly may be simplified. In some embodiments, the one or more center plates 114 may be substantially transparent. For example, the one or more center plates 114 may be made of glass, polycarbonate, acrylic, or various other substantially transparent materials.

Figure 21:
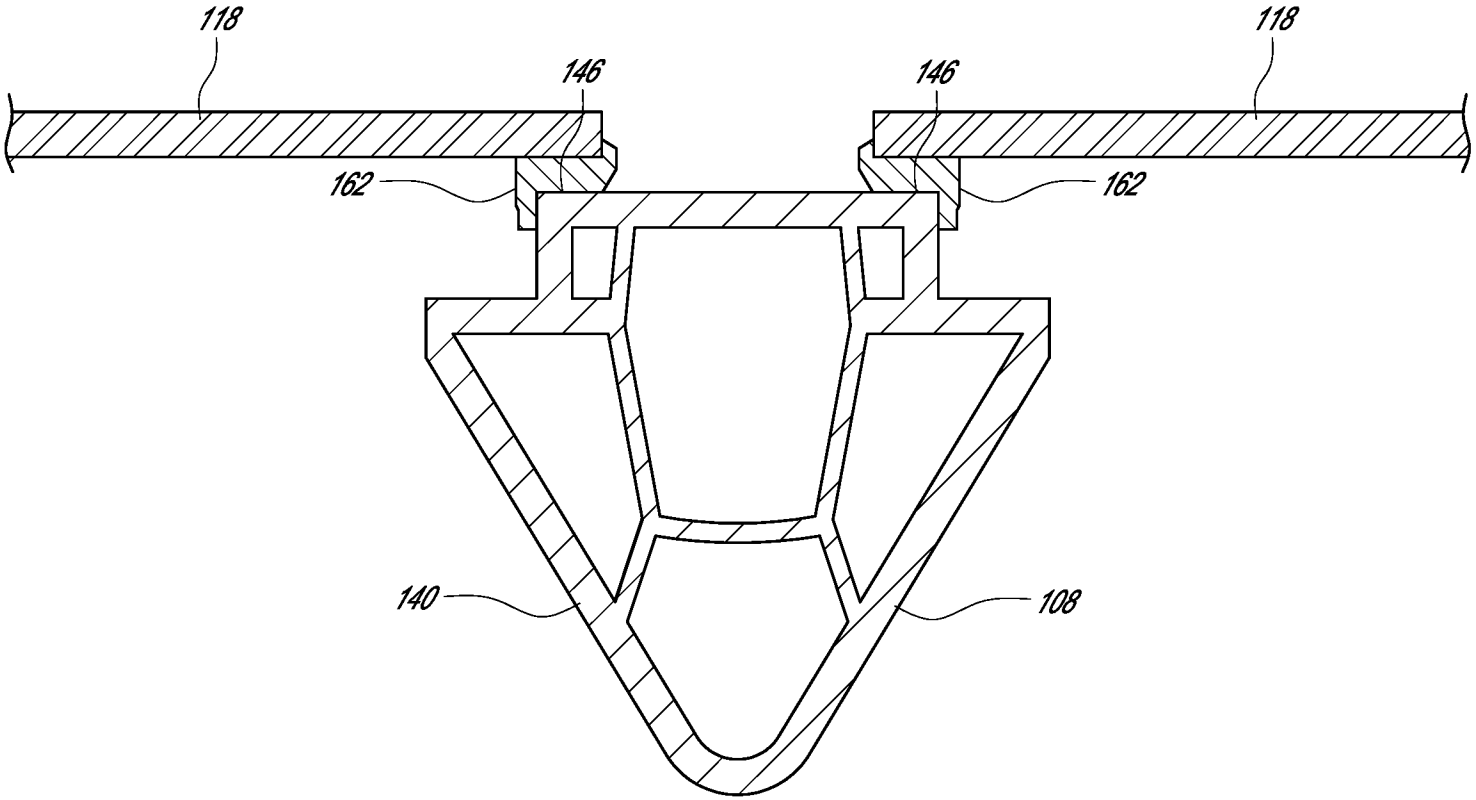
FIG. 21 is a cross-sectional view of a central rail having lids slidably supported on the central rail.
Figure 22:
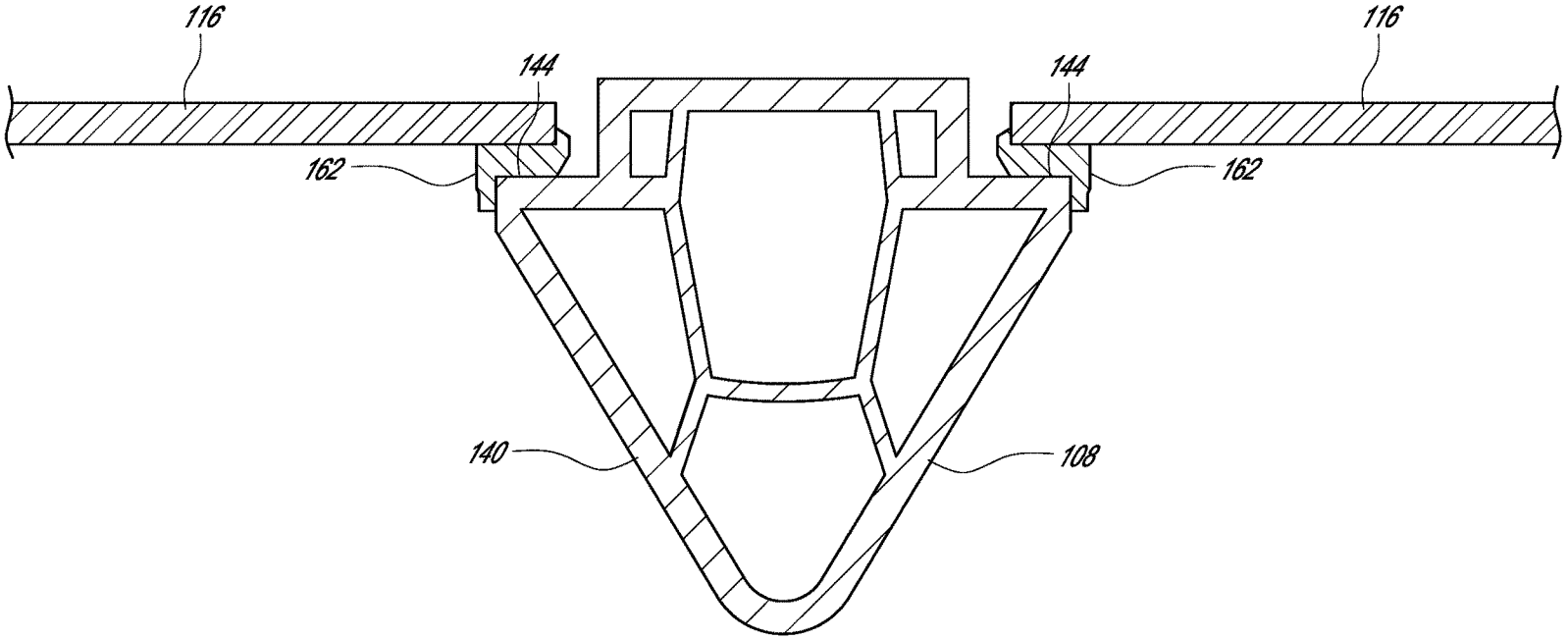
FIG. 22 is a cross-sectional view of an example central rail having lids slidably supported on the central rail.

FIG. 21 is a cross-sectional view of a central rail 108 having lids 118 slidably supported on the support surfaces 146. The lids 118 may include feet 162 at or near the sides thereof. The feet 162 may have a generally Z-shaped configuration, as discussed herein, although various other configurations are possible. FIG. 22 is a cross-sectional view of the central rail 108 having lids 116 slidably supported on the support surfaces 144. The lids 116 may have feet 162 at or near the sides thereof. The feet 162 may have a generally Z-shaped configuration, as discussed herein, although various other configurations are possible.

The lids 116 and 118 may be slidably between a closed position and an open position. FIG. 1 shows the lids 116 and 118 in the closed positions. When the lids 116 and 118 are in the closed positioned, the one or more lids 116 may be positioned on the left side of the cover 100 (e.g., covering about ⅓ of the top opening on the left side), the one or more lids 118 may be positioned on the left side of the cover 100 (e.g., coving about ⅓ of the top opening on the right side), and the one or more center plates 114 may be positioned generally in the middle of the cover (e.g., covering about ⅓ of the top opening along the center thereof).

Figure 23:
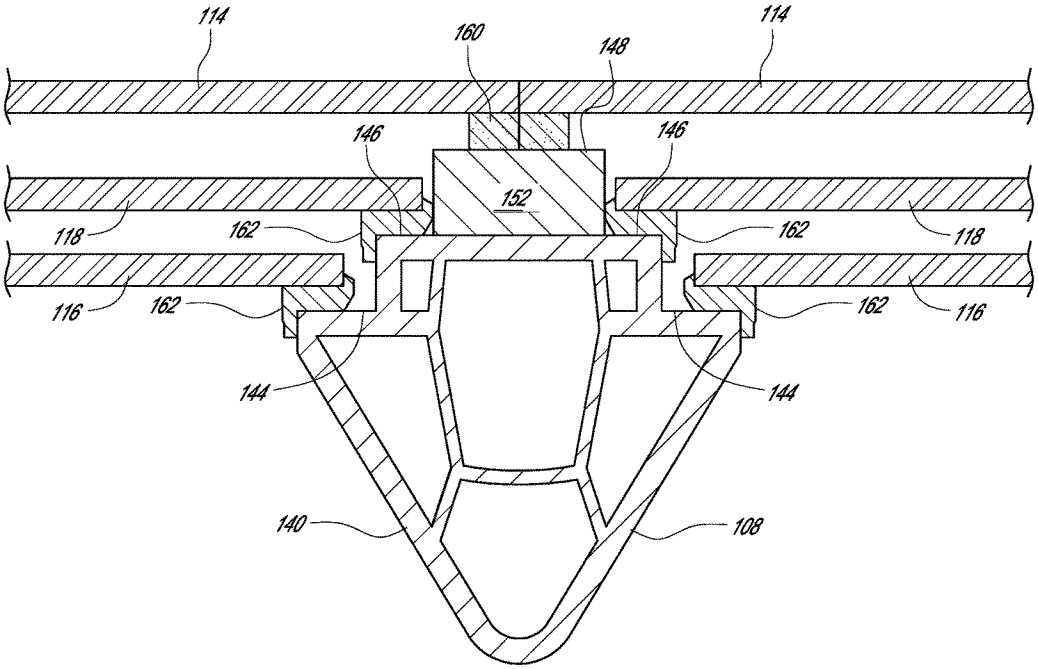
FIG. 23 is a cross-sectional view of an example central rail having the lids in the open position such that the lids are positioned under cover plates.

When in the open position, the lids 116 may slide towards the opposing side of the cover 100 in a direction generally transverse to the longitudinal axis of the cover 100. When fully open, the lids 116 may be positioned generally over the middle ⅓ of the cover. For example, the lids 116 may slide under the center plates 114, since the support surfaces 144 that support the lids 116 are lower than the support surfaces 148 that support the center plates 114. When in the open position, the lids 118 may slide towards the opposing side of the cover 100 in a direction that is generally transverse to the longitudinal axis of the cover 100. When fully open, the lids 118 may be positioned generally over the middle ⅓ of the cover. For example, the lids 118 may slide under the center plates 114, since the support surfaces 146 that support the lids 118 are lower than the support surfaces 148 that support the center plates 114. When a lid 116 and a corresponding lid 118 on the other side of the cover 100 are both in the open position, the lid 116 may be positioned below the lid 118, since the support surfaces 144 that support the lid 116 are lower than the support surfaces 146 that support the lid 118. FIG. 23 is a cross sectional view of a central rail 108 having the lids 118 and lids 116 in the open position such that the lids 118 are positioned above the lids 116, and such that the cover plates 114 are positioned above the lids 118. Various other configurations are possible. For example, the center plates 114 could be disposed on the lower support surfaces 144, and the sliding lids 116 and 118 could be positioned above the center plates 114 when in the open positions, or the center plates 114 may be positioned between the sliding lids 116 and 118.

Figure 25:
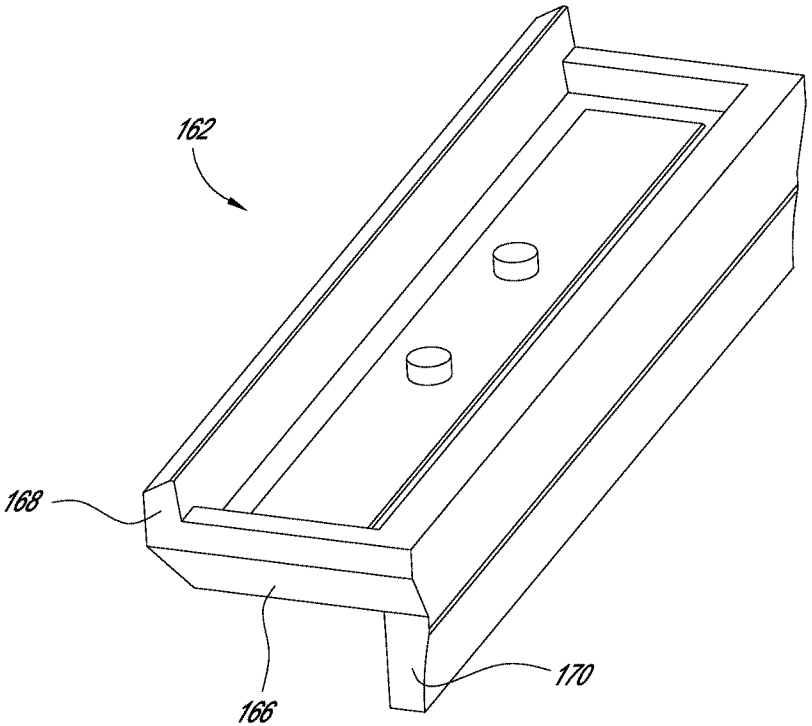
FIG. 25 is a top perspective view of an example foot for use with the lids.
Figure 24:
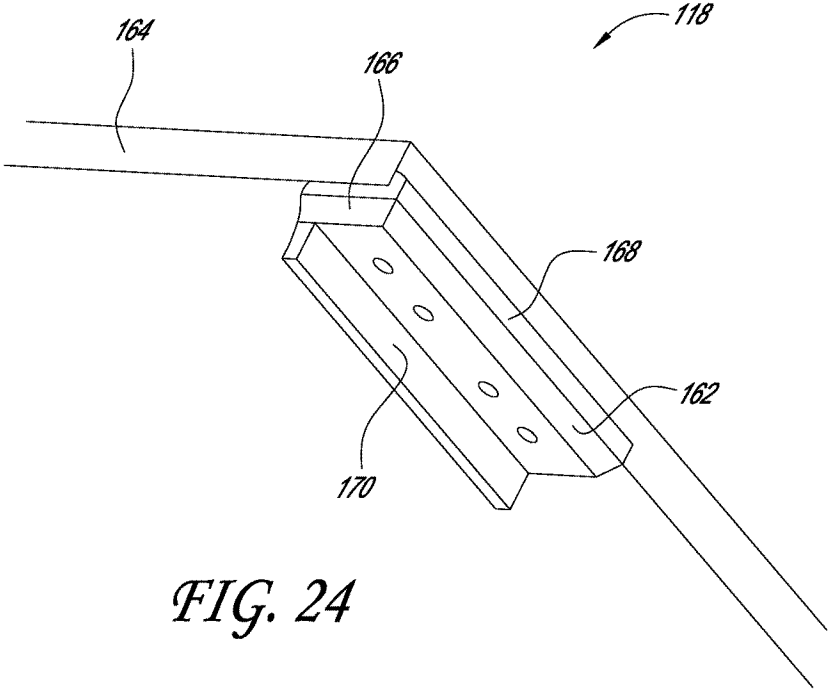
FIG. 24 is a partial bottom perspective view of corner portion of an example embodiment of a lid.

FIG. 24 is a partial bottom perspective view of corner portion of the lid 118 showing a foot 162 attached thereto. FIG. 25 is a top perspective view of the foot 162. The lid 118 may include a lid plate 164, and the foot 162 may be coupled to the lid plate 164 (e.g., at or near the side or corner of the lid plate 164). The foot 162 may be coupled to the lid plate 164 by an adhesive, by double-sided tape, or by other suitable attachment mechanisms. The foot 162 may include a main portion 166, which may be generally horizontal. The bottom surface of the main portion 166 may provide the sliding surface that rests on the corresponding support surface 146 of the rail 108. In some embodiments, the foot 162 may have a cross-sectional shape that is generally Z-shaped. The foot 162 may include an upper flange 168 that extends generally vertically upward from an outer side if the main portion 166 of the foot 162. When coupled to the lid plate 164, the upper flange 168 may be disposed on the side of the lid plate 164, thereby positioning the foot 162 at the side of the lid plate 164. The foot 162 may include a lower flange 170 that may extend generally vertically downward from an inner side of the main portion 166 of the foot 162. The lower flange 170 may be configured to be positioned on the sides of the support surfaces 146 when the lid 118 is mounted onto the rails 108, thereby restricting movement of the lid 118 in the direction that is generally transverse to the sliding direction (as may be seen in FIGS. 21-23). Various other configurations may be used for the feet 162. For example, the upper flange 168 and/or the lower flange 170 may be omitted. In some embodiments, the foot 162 may have a cross-sectional shape this generally L-shaped. Although the foot 162 is described in connection with the lid 118, the lid 116 may also include feet 162 (e.g., at or near the sides or concerns thereof), which may have structure and functionality similar to the feet 162 discussed in connection with the lid 118.

The feet 162 may raise the lid plate 164 off of the support surface 146, thereby forming a gap between the bottom surface of the lid plate 164 and the support surface 146. By reducing the area of contact between the lid 118 and the support surface 146, the feet 162 may facilitate the sliding of the lid 118 on the support surface 146. In some embodiments, the feet 162 may be made from a low friction material, or the feet 162 may have a layer or coating of a low friction material, to facilitate sliding of the lid 118.

Figure 27:
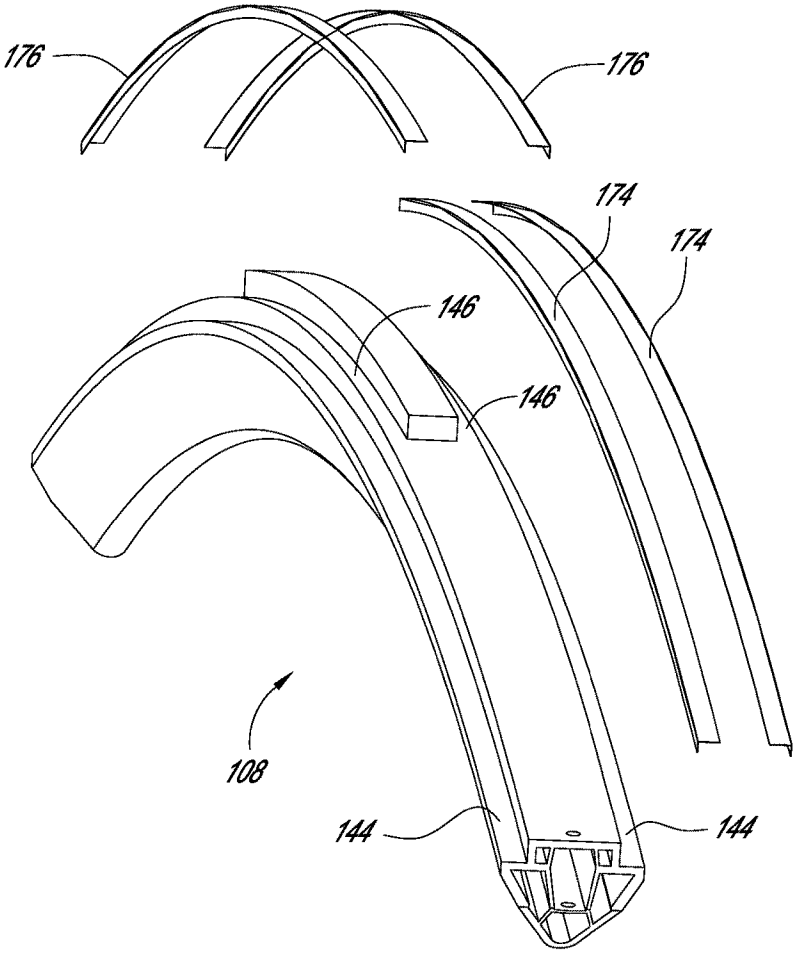
FIG. 27 is an exploded perspective view of the central rail and anti-friction elements of FIG. 26.
Figure 26:
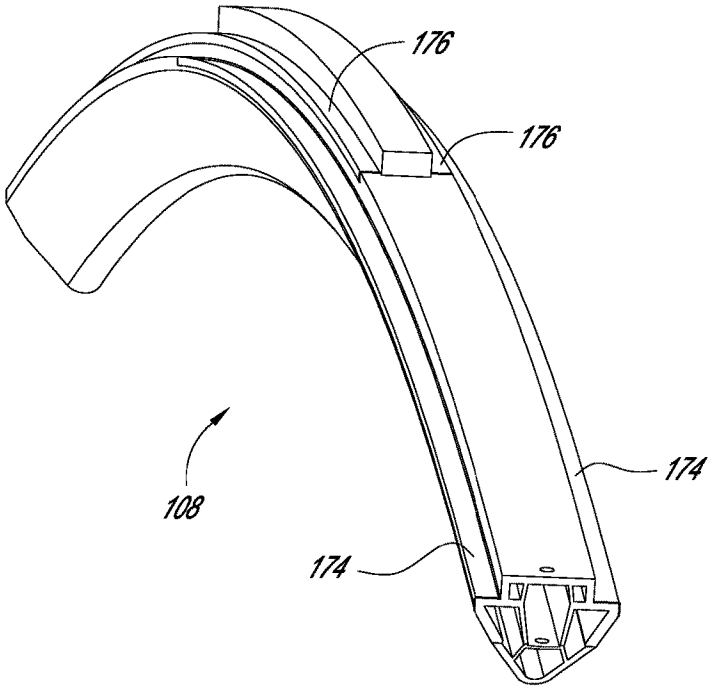
FIG. 26 is a perspective view of an example central rail having anti-friction elements.

With reference now to FIGS. 26 and 27, in some embodiments, the rails 106, 108, and 110 may include an anti-friction layer or coating. FIG. 26 is a perspective view of a rail 108 that includes anti-friction elements 174 and 176 on the corresponding support surfaces 144 and 146. FIG. 26 is an exploded perspective view showing the anti-friction elements 174 and 176 separated from the rail 108. In some embodiments, the anti-friction elements 174 and 176 may be an ultra-high-molecular-weight polyethylene (UHMW) material or another suitably flow friction material. In some embodiments, the anti-friction elements 174 and 176 may have a generally L-shaped cross-sectional shape, so that the anti-friction elements 174 and 176 may wrap around the corners of the support surfaces 144 and 146, thereby providing a low friction surface for the main portion 166 of the feet 162, and for the lower flange 170 of the feet 162, to slide on. The anti-friction elements 174 and 176 may be configured to cover at least a portion of the corresponding support surfaces 144 and 146, and in some embodiments, do not wrap around the corners of the support surfaces 144 and 146. As shown in FIGS. 26 and 27, the anti-friction elements 176 and 174 may extend only partially along the length of the rail 108. For example, the anti-friction elements 174 may extend about ⅔ of the way across the rail 108 along the right side of the rail 108, because the lids 118, which slide over the anti-friction elements 174 and support surfaces 144, may be restricted to the right ⅔ of the cover 100. Similarly, the anti-friction elements 176 may extend about ⅔ of the way across the rail 108 along the left side of the rail 108, because the lids 116, which slide over the anti-friction elements 176 and support surfaces 146, may be restricted to the right ⅔ of the rail 108. In some embodiments, the anti-friction elements 174 and 176 may extend substantially the full length of the rail 108. The anti-friction elements 174 and 176 may be extruded, molded, or milled. The anti-friction elements may be bent to have a curvature that corresponds to the curvature of the rail 108, or may be formed directly into the curved shaped. In some embodiments, the anti-friction elements 174 and 176 may be co-extruded with other portions of the rail 108 (e.g., the main body 140 or supplemental support member 142). In some embodiments, the anti-friction elements 174 and 176 may be flexible and may be bent when attached to the rail 108. In some embodiments, the anti-friction elements 174 and 176 may be applied to the rail 108 as a tape. In some embodiments, the anti-friction elements may be coupled to the rail 108 using an adhesive, a double-sided tape, or other suitable attachment mechanisms.

Figure 28:
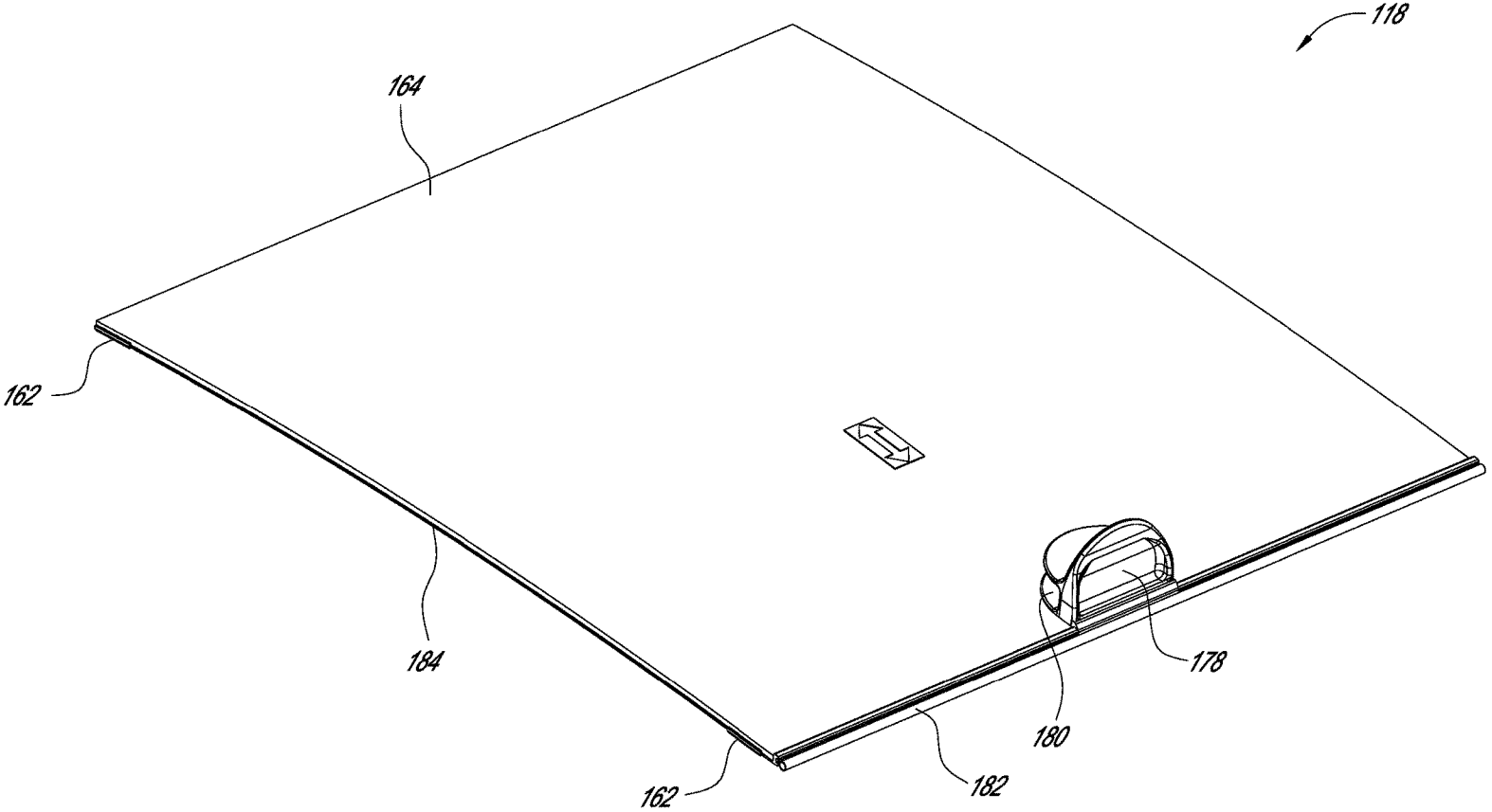
FIG. 28 is a perspective view of an example embodiment of a lid.
Figure 29:
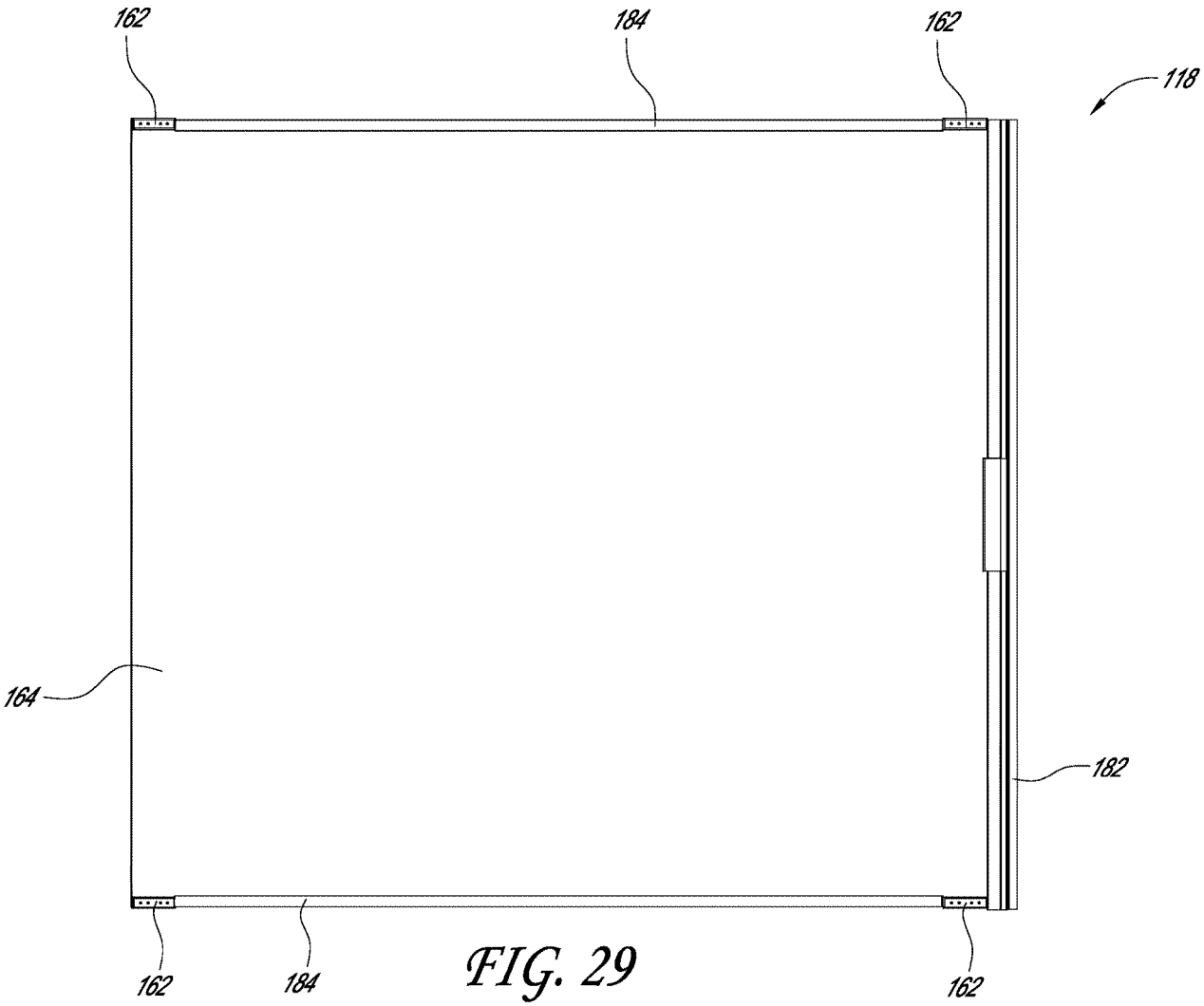
FIG. 29 is a bottom view of the example lid of FIG. 28.

FIG. 28 is a perspective view of an example embodiment of a lid 118. FIG. 29 is a bottom view of the lid 118. The features discussed in connection with the lids 118 may also relate to the lids 116. The lid 118 may include a lid plate 164. The lid plate 164 may be substantially transparent, and may be made of glass, acrylic, polycarbonate or any other suitable material. In some embodiments, the lid plate 164 may be curved (e.g., having a curvature that generally corresponds to the curvature of the rails 106, 108, and 110). As discussed herein, the feet 162 may raise the lid plate 164 off the support surface 146, creating a gap therebetween, which may improve the stability of the lid 118. In some cases, the curvature of the lid plate 164 may be slightly different than the curvature of the rails 106, 108, and 110 (e.g., due to manufacturing tolerances). The difference in curvature between the lid plate 164 and the rails 106, 108, and 110 may cause the lid 118 to high-center on the rails 106, 108, and 110, such that the lid 118 may rock back and forth. The feet 162 on the lid 118 may compensate for the difference in curvature between lid plate 164 and the rails 106, 108, and 110, so that the gap under the lid plate 164 prevents the lid plate 164 from high-centering on the rails 106, 108, and 110.

The lid 118 may include a handle 178 to facilitate sliding the lid 118 between the closed and opened positions. In some embodiments, the handle 178 may be configured to abut against the center plate 114 when the lid 118 is in the fully open position, thereby preventing the lid 118 from sliding past the fully open position. The handle may have a slot 180 configured to receive the center plate 114 when in the open position. The lid 118 may include a cushion member 182 at the end of the lid 118 so that, when the lid 118 is in the closed position, the cushion member 182 abuts against the frame 104 or other portion of the cover 100. The cushion member 182 may include an elastomeric material (e.g., formed into a hollow tube) so that the cushion member 182 may deform when the lid 118 is slid to the closed position.

Figure 30:
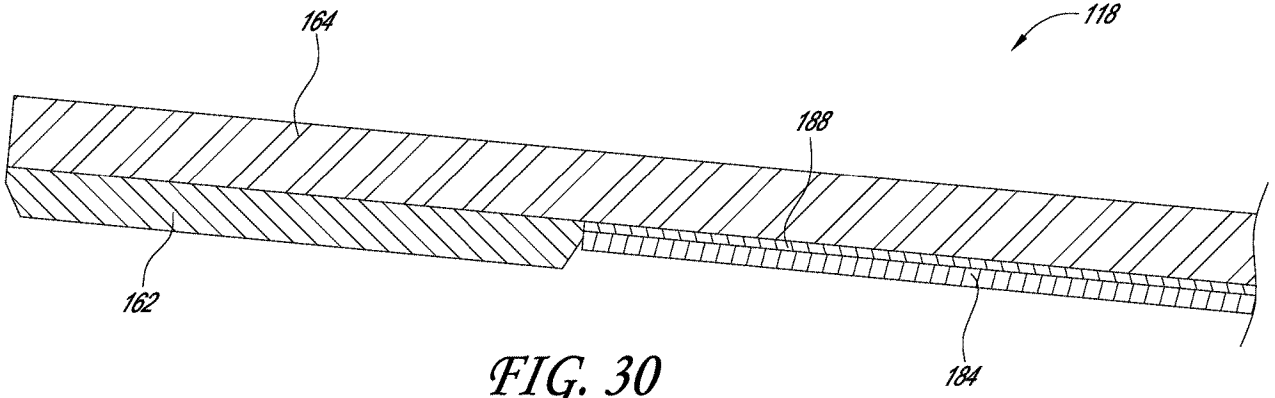
FIG. 30 is a partial cross-sectional view of an end portion of the lid of FIG. 26.
Figure 31:
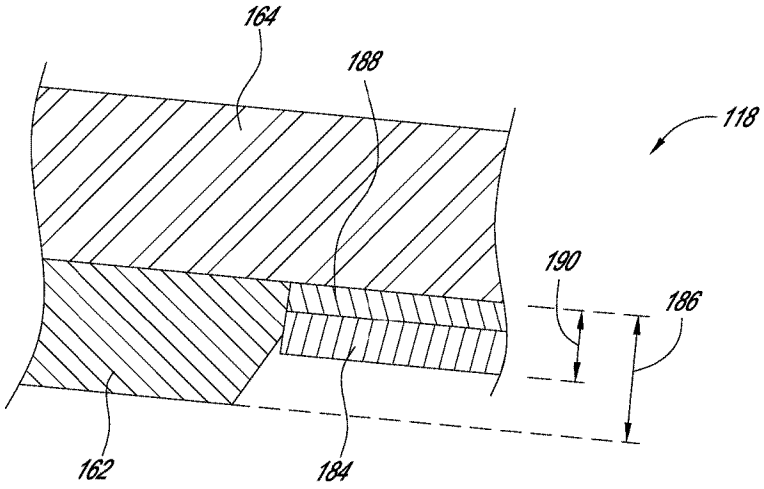
FIG. 31 is a detailed partial cross-sectional view of the lid of FIG. 26.
Figure 32:
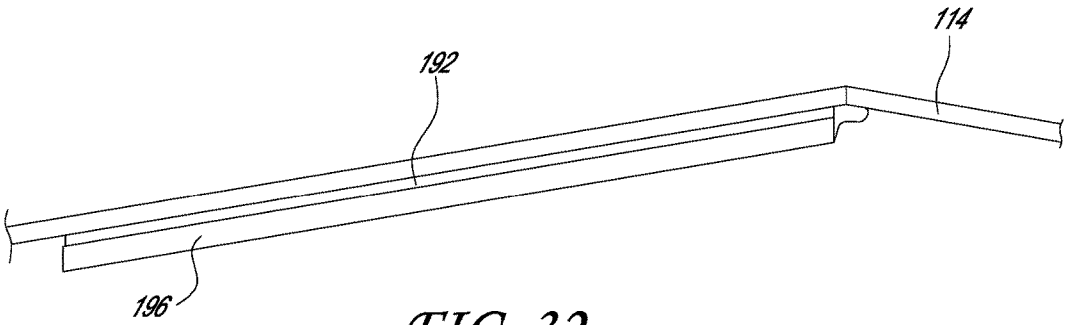
FIG. 32 is a partial perspective view of an example center plate having an example filling element.

In some embodiments, the lid 118 may include one or more filling elements 184. The filling elements 184 may be positioned between the feet 162, and may extend along or near the side of the lid plate 164. FIG. 29 is a bottom view of the lid 118, showing the filling elements 184. FIG. 30 is a partial cross-sectional view of the end of the lid 118. FIG. 31 is a detailed partial cross-sectional view of the lid 118. As discussed herein, the feet 162 may raise the lid plate 164 off of the support surface 146 (not shown in FIGS. 29-31), thereby forming a gap 186 between bottom surface of the lid plate 164 and the support surface 146. In some cases, the gap 186 may permit air exchange between the interior of the refrigeration unit and the surrounding area, which may reduce the efficiency of the refrigeration unit and may cause condensation to form inside the refrigeration unit. The filling elements 184 may be configured to restrict air flow through the gap 186 formed between the lid plate 164 and the support surface 146. In some embodiments, the filling elements 184 may be elongate sealing strips, and may be coupled to the bottom surface of the lid plate 164 (e.g., using an adhesive, a double sided tape 188, or other suitable attachment mechanisms). The filling elements 184 may be rigid, or semi-rigid (e.g., to provide high durability). For example, the filling elements 184 may be made of polyvinyl chloride (PVC) material or any other suitable material. The filling element 184 may be extruded, molded, or milled to the appropriate shape. In some embodiments, the filling element 184 may be extruded to a linear piece, and the linear piece may be curved to correspond to the curvature of the lid plate 164.

In some embodiments, the filling elements 184 may extend substantially the full length of the space between the feet 162 (as shown in FIG. 29). In some embodiments, on or both ends of the filling element 184 may overlap with, abut against, or be positioned near, the corresponding foot 162 on the lid 118. In some embodiments, the filling elements 184 may extend less than the full length between the feet 162 (e.g., extending at least about 75%, at least about 85%, at least about 90%, at least about 95%, at least about 98% of the length between the feet 162). The filling elements 184 may fill at least about 25%, at least about 40%, at least about 50%, at least about 60%, or at least about 75%, of the gap 186. In some embodiments, the filling elements 184 may fill substantially the entire gap 186. In some embodiments, the filling elements 184 may fill less than the entire gap 186, which may prevent the lid 118 from high-centering on the support surface 146 (which may occur if the gap 186 is filled). The filling elements 184 may fill less than or equal to about 90%, less than or equal to about 75%, less than about 65%, less than or equal to about 60%, less than or equal to about 55%, or less than or equal to about 50%, of the gap 186. In some embodiments, the filling elements 184 may fill about 45%, about 50%, about 55%, about 60%, or about 65%, of the gap 186. The filling elements 184 may fill enough of the gap 186 to restrict air flow through the gap 186 and reduce the occurrence of condensation forming inside the refrigeration unit, and the filling elements 184 may leave enough of the hap 186 unfilled to prevent the lid 118 from high-centering on the support surface 146. For example, in some embodiments, the gap 186 may have a height of at least about 0.075 inches and/or less than or equal to about 0.125 inches, and in some cases the gap 186 may have a height of about 0.106 inches. In some embodiments, the filling element 184 may have a height 190 of at least about 0.05 inches and/or less than or equal to about 0.075 inches. Various values outside of these ranges may also be used.

In some embodiments, additional features may be included to reduce air exchange between the interior of the refrigeration unit 102 and the surrounding area, or to otherwise reduce condensation. For example, surfaces inside the refrigeration unit 102 (e.g., the bottom surface of the lid plate 164, the bottom surfaces of the rails 106, 108, and 110, etc.) may be coated with an anti-fog coating (e.g., a hydrophilic coating).

In some embodiments, the center plates 114 may include a filling element 192 that is configured to fill some or all of gap 194 formed between the center plate 114 and the lid plates 164 of the slidable lids 116 and 118. The filling element 192 may be formed of a flexible material. The filling element 192 may be positioned at or near the edge of the center plate 114, and may be coupled to the center plate 114 (e.g., to the bottom surface thereof) by an adhesive, a double-sided tape, or other suitable attachment mechanism. The filling element 192 may extend generally transverse to the direction of movement of the slidable lids 116 and 118. The filling element 192 may include a flexible blade portion 196 that may be configured to flex as the lid plate 164 slides against the blade portion 196.

The filling element 192 may fill at least about 25%, at least about 40%, at least about 50%, at least about 60%, or at least about 75%, of the gap 194. In some embodiments, the filling elements 192 may fill substantially the entire gap 194 (e.g., so that the blade portion 196 abuts against the top surface of the lid plate 164). In some embodiments, the filling elements 192 may fill less than the entire gap 194. The filling elements 192 may fill less than or equal to about 90%, less than or equal to about 75%, less than about 65%, less than or equal to about 60%, less than or equal to about 55%, or less than or equal to about 50%, of the gap 194. In some embodiments, the filling elements 192 may fill about 45%, about 50%, about 55%, about 60%, or about 65%, of the gap 194.

Figure 33:
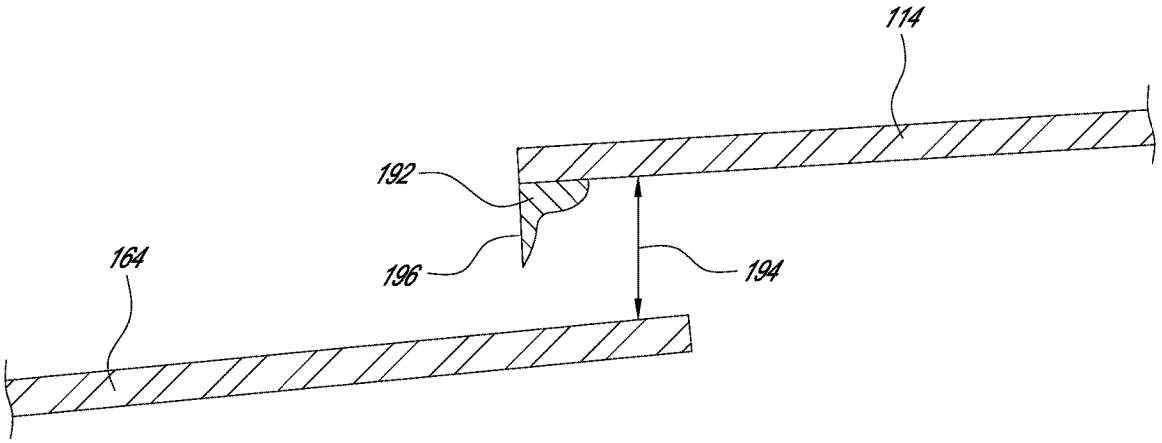
FIG. 33 is a partial cross-sectional view showing the center plate and filling element of FIG. 32 together with the lid plate of an example lid of the cover.

In some embodiments, both sides of the center plate 114 may include filling elements 192. The filling element 192 on one side may fill at some of the gap 194 between the center plate 114 and the lid plate of the lid 116 (as shown in FIG. 33), and the filling element 192 on the other side may fill at least some of the gap between the center plate 114 and the lid plate 164 of the lid 118 (not shown). Because the lids 116 and 118 may be supported by different support surfaces 144 and 146 positioned at different heights, the gaps between the lids 116 and 118 and the center plate 114 may have different heights. In some embodiments, the filling elements 192 on the opposite sides of the center plate 114 may have different heights to accommodate the different gap sizes on the different sides of the center plate 114. In some embodiments, the same or similar sized filling elements 192 may be used on both sides of the center plate 114, which may reduce the number of parts and may simplify assembly of the cover 100.

Various example embodiments have been illustrated and described herein. Many variations to the example embodiments are possible. For example, in some embodiments, the cover may include a single row of lids (e.g., the row of lids 116) and the other row of lids (e.g., the row of lids 118) may be omitted. In some embodiments, the center plate 114 may be positioned at a side of the cover 100, instead of the in the center of the cover. Accordingly, in some embodiments, the cover 100 may include a side plate (which may be stationary similar to the center plate 114 discussed above). In some embodiments, a lid on one side of the center plate 114 (or side plate), may include two or more lid elements that may be configured to slide on different levels of support surfaces, so that the lid elements may slide under (or over) each other as the lid is slid to the open position.

The particular features, structures, or characteristics of the example embodiments may be combined in any suitable manner, as would be apparent to one of skill in the art from this disclosure, to form combinations and subcombinations that are not expressly illustrated or described. Various features that are shown and described as separate components may be grouped together into a single integral component, and various features that are shown and described as a single component may be divided into two or more separate components. Some features and components that are shown and described may be omitted from certain embodiments, and additional features that are not expressly shown or described may be added, as would be understood by one of skill in the art. The scope of the inventions herein disclosed should not be limited by the particular example embodiments described herein.

What is claimed is:

1. A refrigeration unit cover comprising:

a frame comprising two parallel spaced apart rails defining an access opening to a refrigeration unit, each of the rails comprising, in cross section:

an upper support surface, a first shelf extending horizontally outward and past the upper support surface, and a second shelf below the first shelf and extending horizontally outward past the first shelf;

a fixed panel spanning the rails and supported by the upper support surface of the rails;

a first panel supported by the first shelf of the rails such that the first panel is slidable along the first shelf and underneath the fixed panel to permit access to a first portion of the refrigeration unit, the first panel comprising slidable pads attached to a bottom surface of the first panel, the pads comprising a body portion that engages an upper surface of the first shelf and a flange extending away from the bottom surface of the first panel that engages a side surface of the first shelf; and a second panel supported by the second shelf of the rails such that the second panel is slidable along the second shelf and underneath the fixed panel and the first panel to permit access to a second portion of the refrigeration unit, the second panel comprising slidable pads attached to a bottom surface of the second panel, the pads comprising a body portion that engages an upper surface of the second shelf and a flange extending away from the bottom surface of the second panel that engages a side surface of the second shelf.

2. The refrigeration unit cover of claim 1, further comprising a low friction coating applied to the first shelf and the second shelf of the rails.

3. The refrigeration unit cover of claim 1, further comprising a low friction coating applied to top surfaces of the first shelf and the second shelf and to side surfaces of the first shelf and the second shelf.

4. The refrigeration unit cover of claim 1, wherein one of the rails comprises, in cross section:

a third shelf extending horizontally outwards from a side of the rail opposite from the first shelf and the second shelf; and a fourth shelf extending horizontally outwards past the third shelf from the side of the rail opposite from the first shelf and the second shelf, wherein the third shelf and the fourth shelf support respective third and fourth panels.

5. The refrigeration unit cover of claim 1, wherein the upper support surface extends along approximately ⅓ or less of a length of the rails.

6. The refrigeration unit cover of claim 1, wherein the rails have an arched shape.

7. The refrigeration unit cover of claim 6, wherein the first panel and the second panel are curved glass.

* * * * *